US011151932B2

(12) United States Patent
Kuo et al.

(10) Patent No.: US 11,151,932 B2
(45) Date of Patent: Oct. 19, 2021

(54) DRIVING SYSTEM

(71) Applicant: MACROBLOCK, INC., Hsinchu (TW)

(72) Inventors: Chen-Yuan Kuo, Hsinchu (TW); Chi-Min Hsieh, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 0 days.

(21) Appl. No.: 17/198,880

(22) Filed: Mar. 11, 2021

(65) Prior Publication Data

US 2021/0287600 A1 Sep. 16, 2021

(30) Foreign Application Priority Data

Mar. 13, 2020 (TW) ..... 109108301
Mar. 2, 2021 (TW) ..... 110107358

(51) Int. Cl.
*G09G 3/32* (2016.01)

(52) U.S. Cl.
CPC ..... *G09G 3/32* (2013.01); *G09G 2310/0267* (2013.01); *G09G 2310/0289* (2013.01)

(58) Field of Classification Search
CPC ..... G09G 2310/0267; G09G 2310/0289; G09G 3/32
See application file for complete search history.

(56) References Cited

U.S. PATENT DOCUMENTS

2007/0001939 A1* 1/2007 Hashimoto ..... G09G 3/3233 345/76
2012/0223648 A1 9/2012 Jin et al.
2013/0099681 A1* 4/2013 Williams ..... H04N 5/57 315/185 R
2016/0042691 A1* 2/2016 Na ..... G09G 3/3258 345/205

* cited by examiner

*Primary Examiner* — Muhammad N Edun
(74) *Attorney, Agent, or Firm* — Fish & Richardson P.C.

(57) ABSTRACT

A driving system is operatively associated with a light emitting array that includes a plurality of scan lines, a plurality of channel lines and a plurality of light emitting elements. The driving system includes a voltage converter circuit and a driver circuit. The voltage converter circuit converts, based on a control signal, an input voltage into an output voltage that has a magnitude related to the control signal. The driver circuit drives the light emitting elements via the scan lines and the channel lines, is operable, based on voltages at the channel lines, to pull or not to pull a voltage at a common node to a logic level, and generates the control signal based on the voltage at the common node.

20 Claims, 16 Drawing Sheets

DRIVING SYSTEM

CROSS-REFERENCE TO RELATED APPLICATION

This application claims priority of Taiwanese Patent Application Nos. 109108301 and 110107358, respectively filed on Mar. 13, 2020 and Mar. 2, 2021.

FIELD

The disclosure relates to a driving system, and more particularly to a driving system for driving a light emitting device.

BACKGROUND

Referring to FIGS. 1 and 2, U.S. Patent Application Publication No. 2012/0223648 discloses a first conventional driving system that includes at least one light emitting diode (LED) driver 215 (e.g., one in FIG. 1 and three in FIG. 2), a processing device 210 and a boost converter 220. Each of the at least one LED driver 215 is coupled to a plurality of corresponding LED strings 225 (e.g., two in both FIGS. 1 and 2). The processing device 210 is coupled to the at least one LED driver 215. The boost converter 220 is coupled to the processing device 210 and the LED strings 225.

The first conventional driving system requires the processing device 210 to receive information related to the LED strings 225 from the at least one LED driver 215, and to control, based on the received information, the boost converter 220 to adjust a magnitude of a common voltage provided by the boost converter 220 to the LED strings 225, leading to additional hardware cost.

Referring to FIG. 3, a second conventional driving system includes a plurality of LED drivers 230 (e.g., two in FIG. 3), a voltage divider 231, a power supply 232 and a resistor (R3). The LED drivers 230 are coupled to one another, and are each used to drive a plurality of corresponding LED strings (not shown). The voltage divider 231 is coupled to a common node of the LED drivers 230 via the resistor (R3). The power supply 232 is coupled to the voltage divider 231, and is used to power the LED strings. Each of the LED drivers 230 adjusts, based on signals generated thereby for driving the corresponding LED strings, a magnitude of a current drawn thereby from the voltage divider 231, so that the power supply 232 changes a magnitude of a voltage provided thereby to the LED strings. However, when the currents drawn by the LED drivers 230 have different magnitudes, the voltage provided by the power supply 232 will not have an expected (correct) magnitude. In addition, resistances of resistors (R1, R2) of the voltage divider 231 have to be designed according to a number of the LED drivers 230, which increases design difficulty.

SUMMARY

Therefore, an object of the disclosure is to provide a driving system that can alleviate at least one drawback of the prior art.

According to an aspect of the disclosure, the driving system is operatively associated with a light emitting device that includes a light emitting array. The light emitting array includes a plurality of scan lines, a plurality of channel lines, and a plurality of light emitting elements that are arranged in a matrix with a plurality of rows and a plurality of columns. In the light emitting array, with respect to each of the rows of the light emitting elements, the light emitting elements of the row are coupled to a respective one of the scan lines, and with respect to each of the columns of the light emitting elements, the light emitting elements of the column are coupled to a respective one of the channel lines. The driving system includes a voltage converter circuit and a driver circuit. The voltage converter circuit is to receive an input voltage and a control signal, and converts, based on the control signal, the input voltage into an output voltage that has a magnitude related to the control signal. The driver circuit is coupled to the voltage converter circuit and a common node, and is to be further coupled to the scan lines and the channel lines of the light emitting array. The driver circuit drives the light emitting elements of the light emitting array via the scan lines and the channel lines of the light emitting array, is operable, based on voltages at the channel lines of the light emitting array, to pull or not to pull a voltage at the common node to a logic level, and generates, based on the voltage at the common node, the control signal for receipt by the voltage converter circuit.

According to another aspect of the disclosure, the driving system is operatively associated with a light emitting array. The light emitting array includes a plurality of scan lines, a plurality of channel lines, and a plurality of light emitting elements that are arranged in a matrix with a plurality of rows and a plurality of columns. In the light emitting array, with respect to each of the rows, the light emitting elements in the row are coupled to a respective one of the scan lines, and with respect to each of the columns, the light emitting elements in the column are coupled to a respective one of the channel lines. The driving system includes a voltage converter circuit and a driver circuit. The voltage converter circuit is to receive an input voltage and a control signal, and to convert, based on the control signal, the input voltage into an output voltage that has a magnitude related to the control signal. The driver circuit is coupled to the voltage converter circuit and a common node, and is to be further coupled to the scan lines and the channel lines of the light emitting array. The driver circuit drives the light emitting elements of the light emitting array via the scan lines and the channel lines of the light emitting array, is operable to pull or not to pull a voltage at the common node to a logic level, and generates, based on the voltage at the common node, the control signal for receipt by the voltage converter circuit. The driver circuit includes a plurality of current drivers which are to be respectively coupled to the channel lines of the light emitting array, and each of which provides a drive current to the channel line coupled thereto based on a drive voltage. Each of the current drivers includes an amplifier, a transistor and a resistor. The amplifier has a non-inverting input terminal that is to receive the drive voltage, an inverting input terminal and an output terminal. The transistor has a first terminal that is to be coupled to the channel line corresponding to the current driver and that provides the drive current, a second terminal that is coupled to the inverting input terminal of the amplifier, and a control terminal that is coupled to the output terminal of the amplifier. The resistor is coupled between the second terminal of the transistor and ground.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
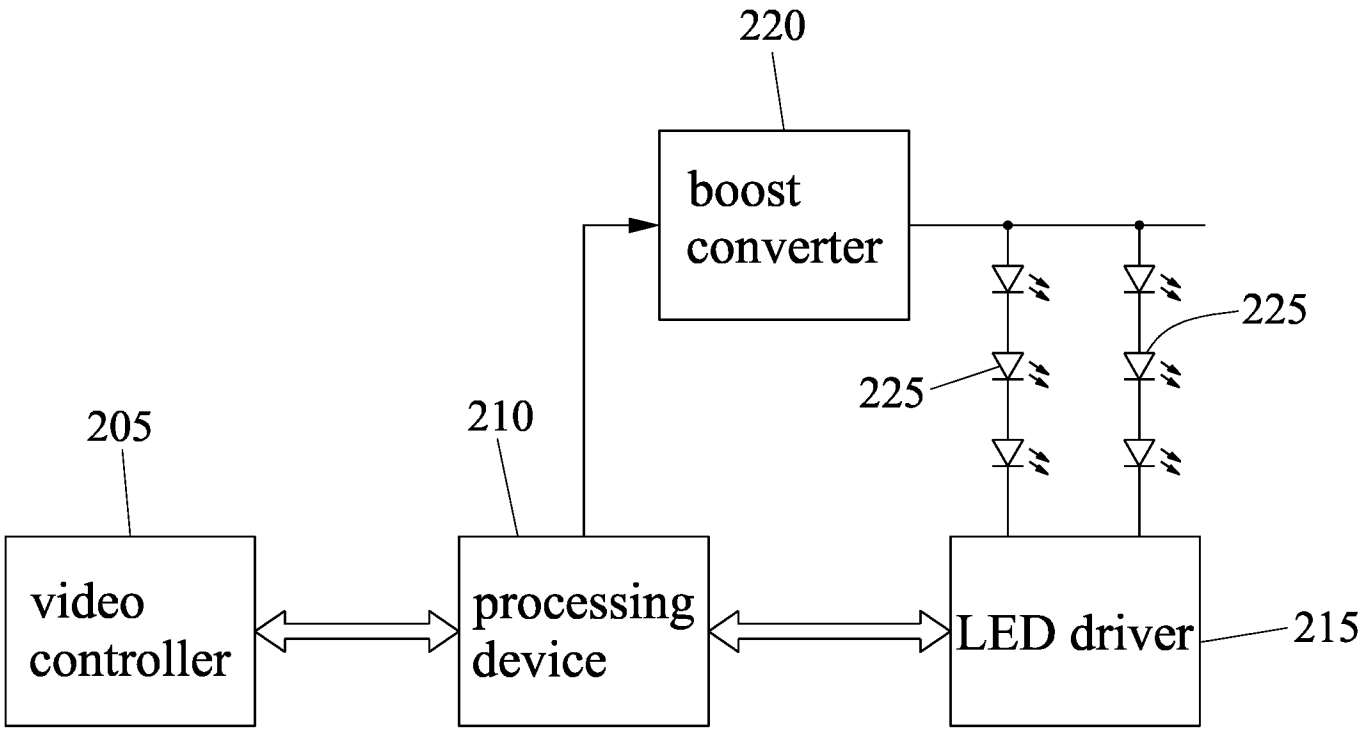
FIG.1 PRIOR ART
FIG. 1 is a circuit block diagram illustrating an implementation of a first conventional driving system.
Figure 2:
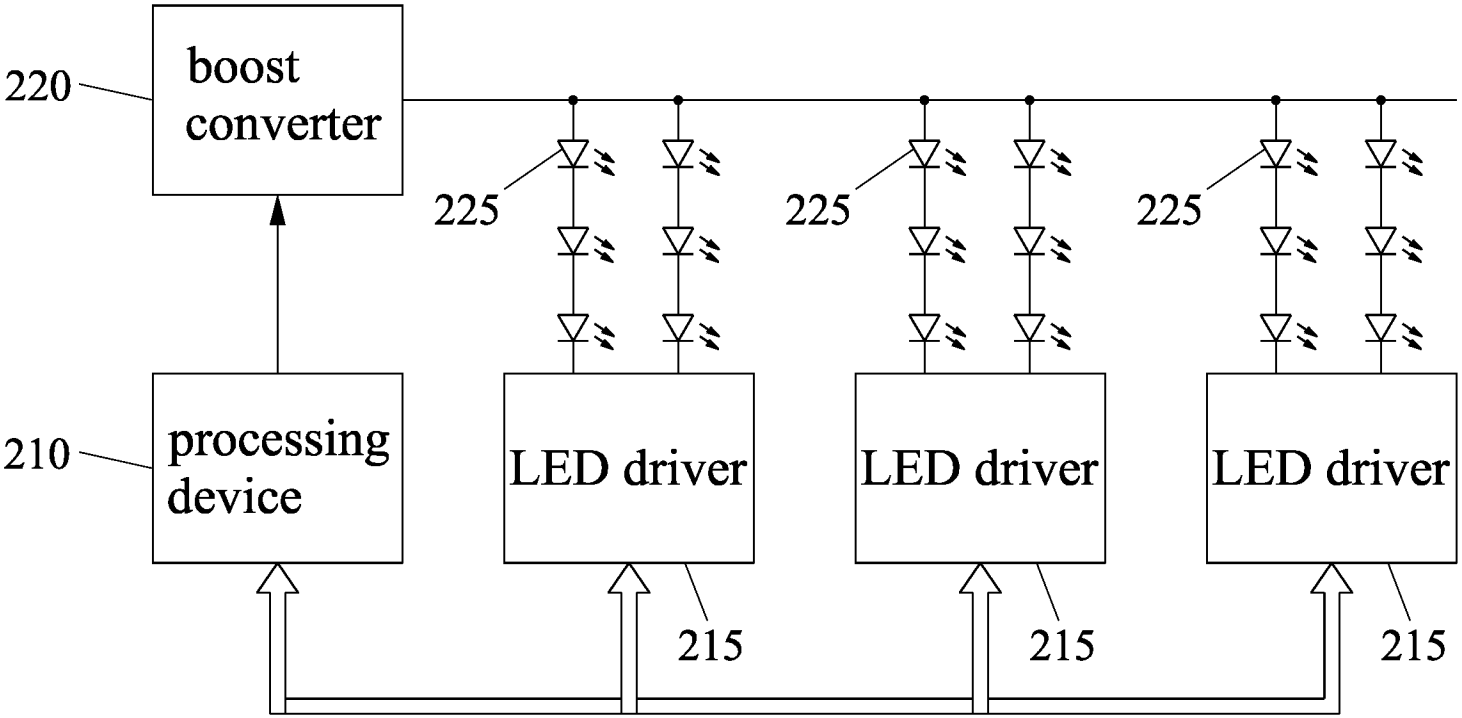
FIG.2 PRIOR ART
FIG. 2 is a circuit block diagram illustrating another implementation of the first conventional driving system.
Figure 3:
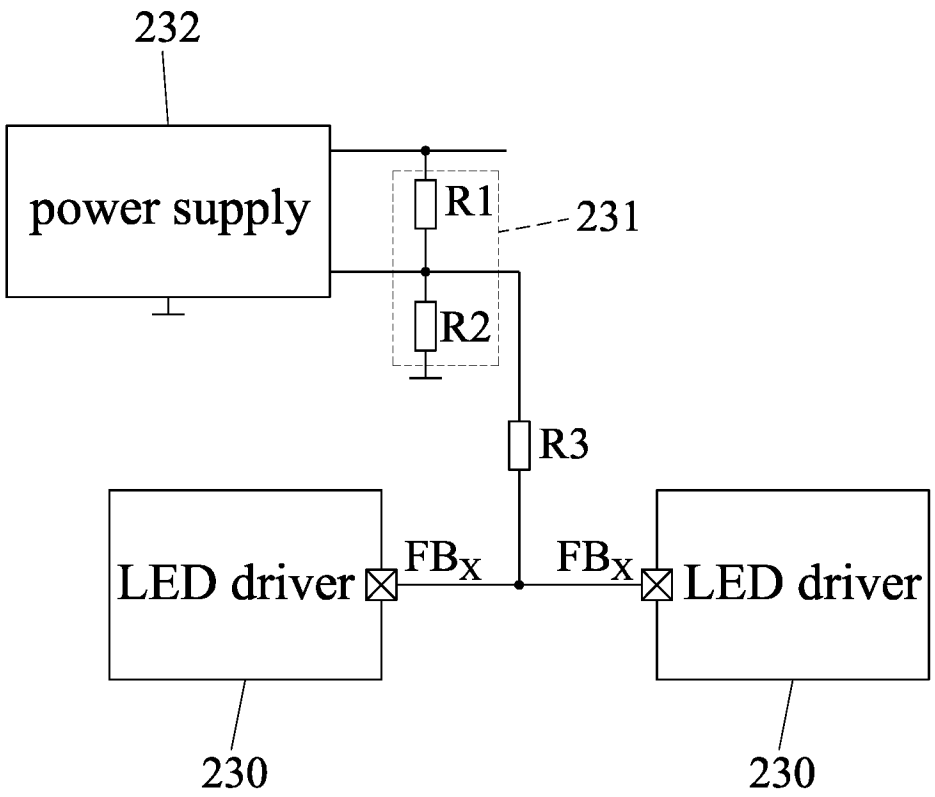
FIG.3 PRIOR ART
FIG. 3 is a circuit block diagram illustrating a second conventional driving system.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 4:
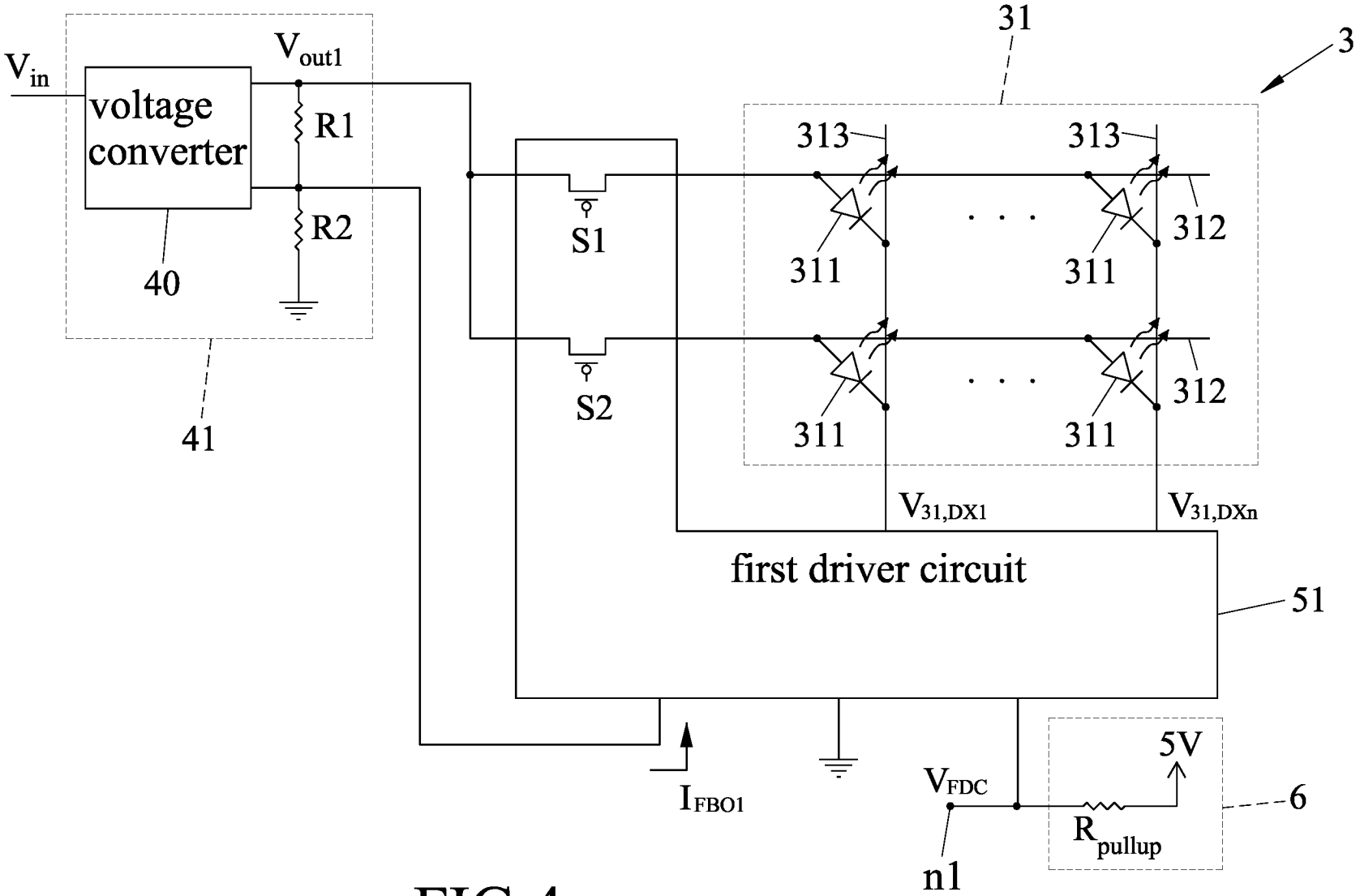
FIG. 4 is a circuit block diagram illustrating a first embodiment of a driving system according to the disclosure.

Referring to FIG. 4, a first embodiment of a driving system according to the disclosure is operatively associated with a light emitting device 3 that includes a first light emitting array 31. The first light emitting array 31 includes a plurality of scan lines 312, a plurality of channel lines 313, and a plurality of light emitting elements 311 (e.g., light emitting diodes (LEDs)) that are arranged in a matrix with a plurality of rows and a plurality of columns. In the first light emitting array 31, with respect to each of the rows, the light emitting elements 311 in the row are coupled to a respective one of the scan lines 312, and with respect to each of the columns, the light emitting elements 311 in the column are coupled to a respective one of the channel lines 313. For illustration purposes, the first light emitting array 31 includes two scan lines 312 in this embodiment. The driving system of this embodiment includes a first voltage converter circuit 41, a first driver circuit 51 and a pull circuit 6.

The first voltage converter circuit 41 is to receive an input voltage ($V_{in}$) and a first control signal, and to, based on the first control signal, convert the input voltage ($V_{in}$) into a first output voltage ($V_{out1}$) that has a magnitude related to the first control signal. In this embodiment, the first voltage converter circuit 41 includes a voltage converter 40 and two resistors (R1, R2). The voltage converter 40 has an input terminal, an output terminal and a control terminal, is to receive the input voltage ($V_{in}$) at the input terminal thereof, and is to, based on a voltage at the control terminal thereof, convert the input voltage ($V_{in}$) into the first output voltage ($V_{out1}$) that is outputted at the output terminal thereof. The resistor (R1) is coupled between the output terminal and the control terminal of the voltage converter 40. The resistor (R2) is coupled between the control terminal of the voltage converter 40 and ground. The first control signal is received at a common node of the resistors (R1, R2).

The first driver circuit 51 is coupled to the first voltage converter circuit 41 and a common node (n1), and is adapted to be further coupled to the scan lines 312 and the channel lines 313 of the first light emitting array 31. The first driver circuit 51 drives the light emitting elements 311 of the first light emitting array 31 via the scan lines 312 and the channel lines 313 of the first light emitting array 31, is operable, based on voltages ($V_{31,DX1}$-$V_{31,DXn}$) at the channel lines 313 of the first light emitting array 31, to pull or not to pull a voltage ($V_{FDC}$) at the common node (n1) to a first logic level (e.g., a logic "0" level), and is to generate, based on the voltage ($V_{FDC}$), the first control signal for receipt by the first voltage converter circuit 41. In this embodiment, the first driver circuit 51 includes a plurality of switches (e.g., two switches (S1, S2) in this embodiment). Each of the switches (S1, S2) is coupled between the output terminal of the voltage converter 40 of the first voltage converter circuit 41 and a respective one of the scan lines 312 of the first light emitting array 31. For each of the switches (S1, S2), the light emitting elements 311 coupled to the switch can emit light when the switch is in an ON state, and cannot emit light when the switch is in an OFF state. In addition, the first control signal is a current signal ($I_{FBO1}$) that flows from the first voltage converter circuit 41 to the first driver circuit 51.

The pull circuit 6 is coupled to the common node (n1), and pulls the voltage ($V_{FDC}$) to a second logic level (e.g., a logic "1" level) when the voltage ($V_{FDC}$) is not pulled to the first logic level. In this embodiment, the pull circuit 6 includes a resistor ($R_{pullup}$). The resistor ($R_{pullup}$) has a first terminal that is to receive a supply voltage with a magnitude of, for example, 5V, and a second terminal that is coupled to the common node (n1).

Referring to FIGS. 4 to 7, operations of the driving system of this embodiment will be described in more detail below.

Each light emitting cycle of the driving system of this embodiment is divided into a plurality of time periods (T) (e.g., two in this embodiment). Each of the time periods (T) is divided into three time intervals that include a drive time interval (t0), a first time interval (t1) and a second time interval (t2).

For each of the rows of the light emitting elements 311 of the first light emitting array 31, the first driver circuit 51 causes the switch (S1/S2) that is coupled to the light emitting elements 311 of the row to be in the ON state in a respective one of the time periods (T), causes the other switch (S1/S2) to be in the OFF state in the respective time period (T), and causes the light emitting elements 311 of the row to emit light in the drive time interval (t0) of the respective time period (T).

In each of the time periods (T), the first driver circuit 51 is operable, based on the voltages ($V_{31,DX1}$-$V_{31,DXn}$) in the drive time interval (t0), to pull or not to pull the voltage ($V_{FDC}$) to the first logic level. When, in the drive time interval (t0), at least one of the voltages ($V_{31,DX1}$-$V_{31,DXn}$) is smaller than a predetermined first reference voltage ($V_{ref1}$) in magnitude, the first driver circuit 51 pulls the voltage ($V_{FDC}$) to the first logic level in the first time interval (t1). When, in the drive time interval (t0), none of the voltages ($V_{31,DX1}$-$V_{31,DXn}$) is smaller than the predetermined first reference voltage ($V_{ref1}$) in magnitude and at least one of the voltages ($V_{31,DX1}$-$V_{31,DXn}$) is smaller than a predetermined second reference voltage ($V_{ref2}$) in magnitude, the first driver circuit 51 pulls the voltage ($V_{FDC}$) to the first logic level in the second time interval (t2). The predetermined second reference voltage ($V_{ref2}$) is greater than the predetermined first reference voltage ($V_{ref1}$) in magnitude. Otherwise, the first driver circuit 51 does not pull the voltage ($V_{FDC}$) to the first logic level in any of the first and second time intervals (t1, t2).

Figure 5:
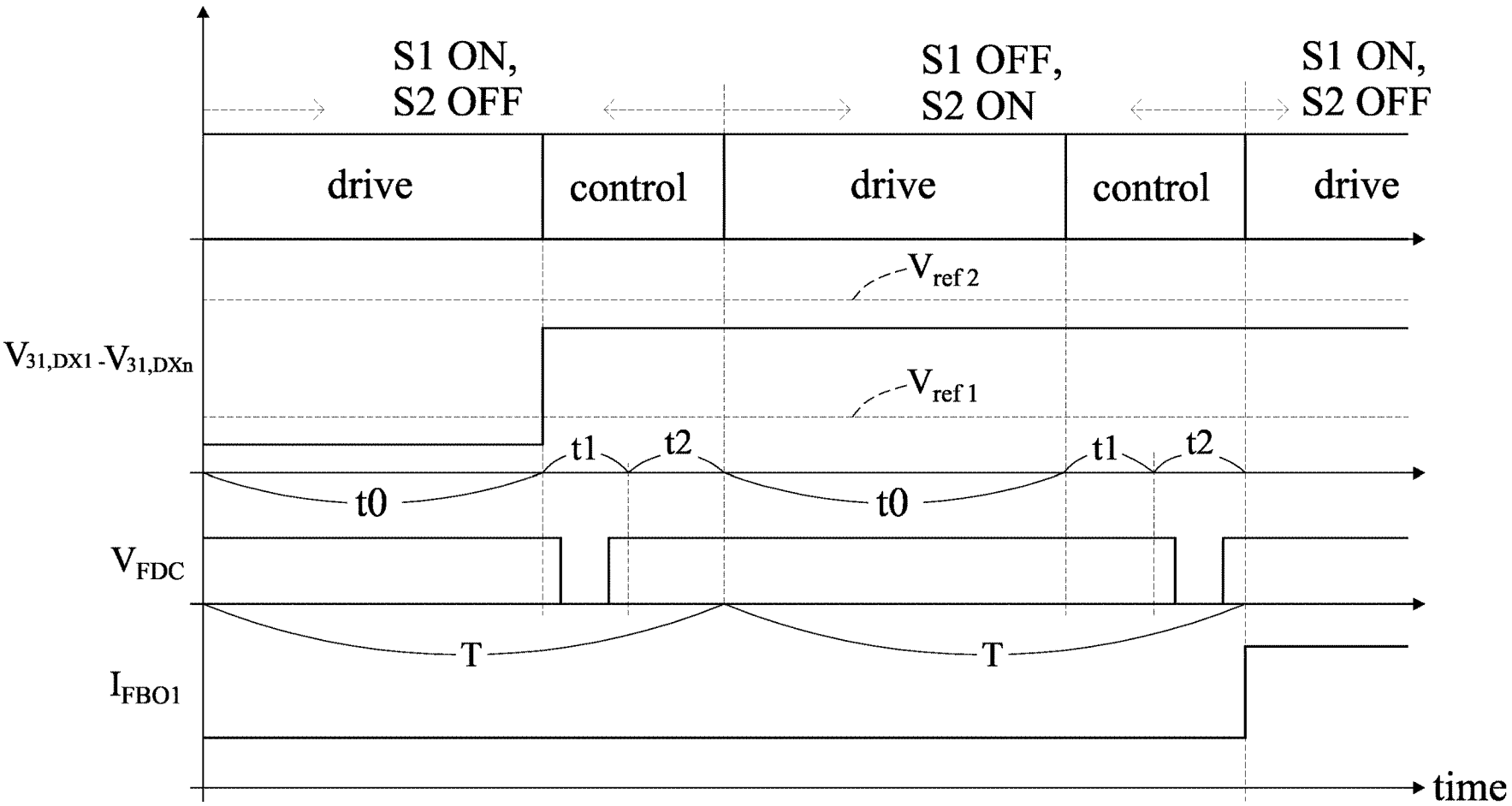
FIGS. 5 to 7 are exemplary timing diagrams illustrating operation of the first embodiment.
Figure 6:
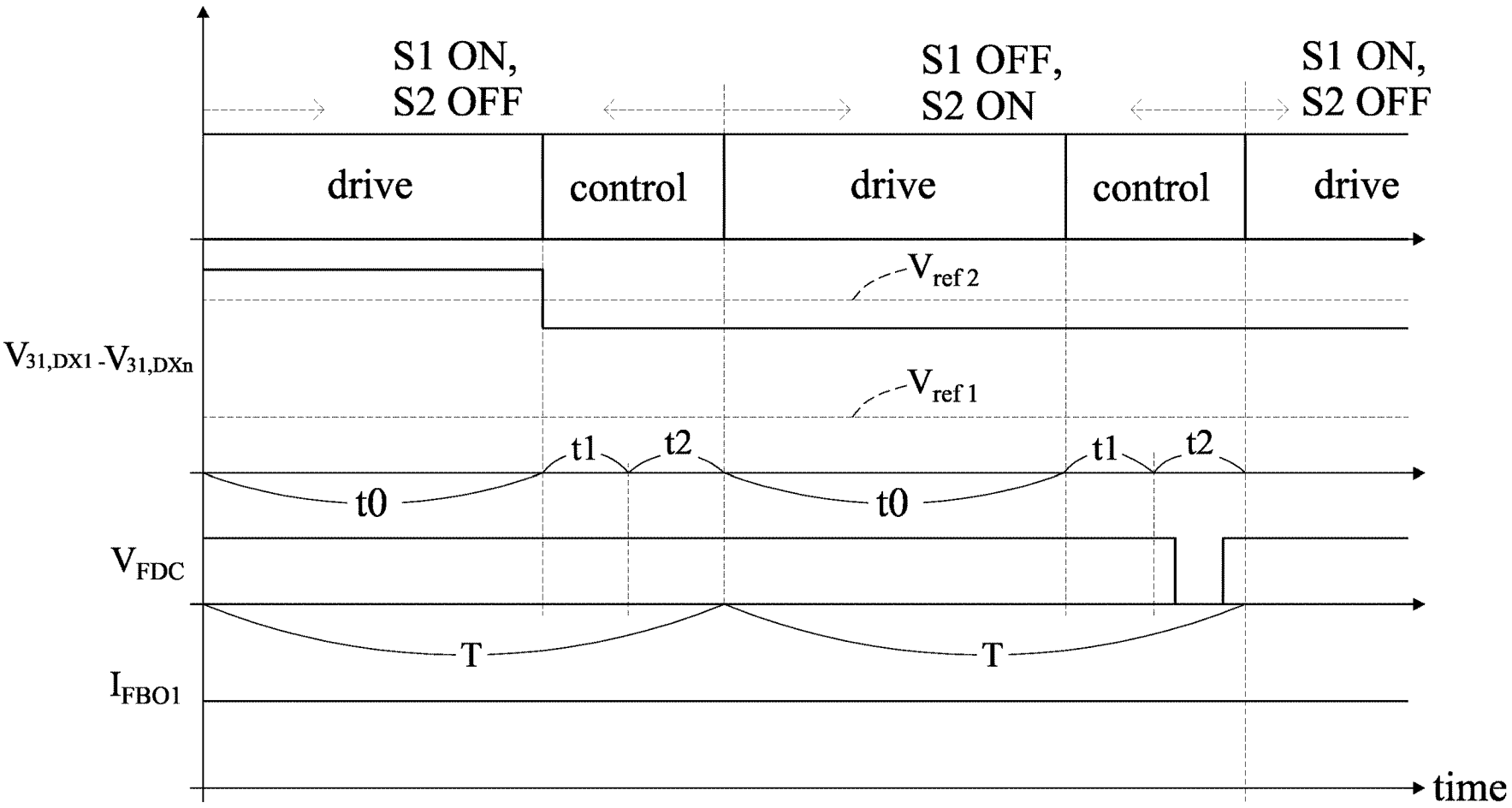
Figure 7:
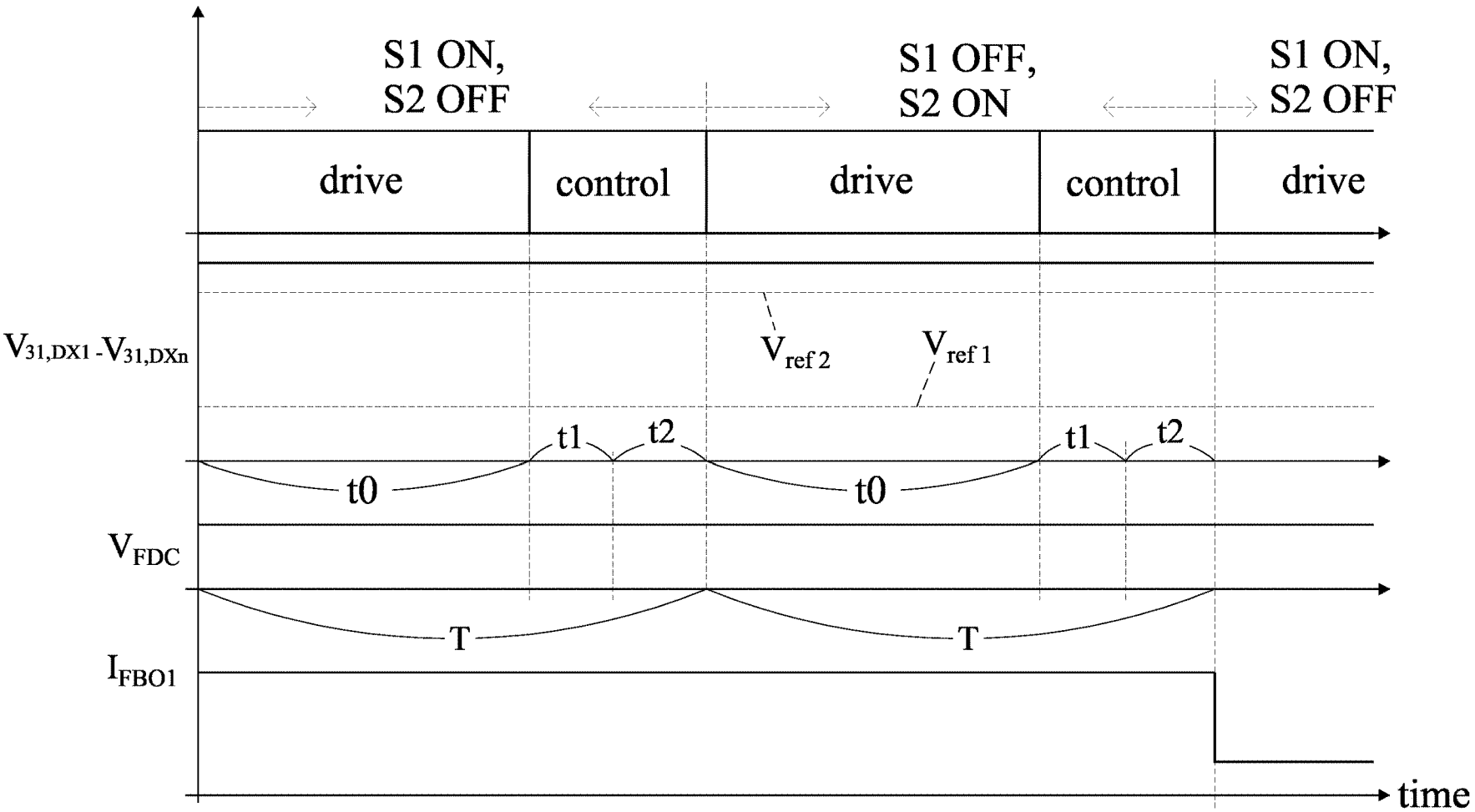

In an example as shown in FIG. 5, in the time period (T) where the switch (S1) is in the ON state while the switch (S2) is in the OFF state, the voltage ($V_{FDC}$) is pulled to the first logic level in the first time interval (t1) since all of the voltages ($V_{31,DX1}$-$V_{31,DXn}$) are smaller than the predetermined first reference voltage ($V_{ref1}$) in the drive time interval (t0). In the time period (T) where the switch (S1) is in the OFF state while the switch (S2) is in the ON state, the voltage ($V_{FDC}$) is pulled to the first logic level in the second time interval (t2) since all of the voltages ($V_{31,DX1}$-$V_{31,DXn}$) are greater than the predetermined first reference voltage ($V_{ref1}$) and smaller than the predetermined second reference voltage ($V_{ref2}$) in the drive time interval (t0). In another example as shown in FIG. 6, in the time period (T) where the switch (S1) is in the ON state while the switch (S2) is in the OFF state, the voltage ($V_{FDC}$) is not pulled to the first logic level in any of the first and second time intervals (t1, t2) since all of the voltages ($V_{31,DX1}$-$V_{31,DXn}$) are greater than the predetermined second reference voltage ($V_{ref2}$) in the drive time interval (t0). In the time period (T) where the switch (S1) is in the OFF state while the switch (S2) is in the ON state, the voltage ($V_{FDC}$) is pulled to the first logic level in the second time interval (t2) since all of the voltages ($V_{31,DX1}$-$V_{31,DXn}$) are greater than the predetermined first reference voltage ($V_{ref1}$) and smaller than the predetermined second reference voltage ($V_{ref2}$) in the drive time interval (t0). In yet another example as shown in FIG. 7, in each of the time periods (T), the voltage ($V_{FDC}$) is not pulled to the first logic level in any of the first and second time intervals (t1, t2) since all of the voltages ($V_{31,DX1}$-$V_{31,DXn}$) are greater than the predetermined second reference voltage ($V_{ref2}$) in the drive time interval (t0).

With respect to each light emitting cycle, when the voltage ($V_{FDC}$) is pulled to the first logic level in the first time interval (t1) of at least one of the time periods (T) in the light emitting cycle, the first driver circuit 51 increases the magnitude of the current ($I_{FBO1}$) at the end of the light emitting cycle, and the first voltage converter circuit 41 increases the magnitude of the first output voltage ($V_{out1}$) in response. When the voltage ($V_{FDC}$) is not pulled to the first logic level in the first time interval (t1) of any of the time periods (T) in the light emitting cycle, and when the voltage ($V_{FDC}$) is pulled to the first logic level in the second time interval (t2) of at least one of the time periods (T) in the light emitting cycle, the first driver circuit 51 keeps the magnitude of the current ($I_{FBO1}$) unchanged at the end of the light emitting cycle (i.e., the magnitude of the current ($I_{FBO1}$) in the next light emitting cycle would be the same as the magnitude of the current ($I_{FBO1}$) in the current light emitting cycle), so the first voltage converter circuit 41 keeps the magnitude of the first output voltage ($V_{out1}$) unchanged. When the voltage ($V_{FDC}$) is not pulled to the first logic level in any of the first and second time intervals (t1, t2) of any of the time periods (T) in the light emitting cycle, the first driver circuit 51 decreases the magnitude of the current ($I_{FBO1}$) at the end of the light emitting cycle, and the first voltage converter circuit 41 decreases the magnitude of the first output voltage ($V_{out1}$) in response.

In the example as shown in FIG. 5, the magnitude of the current ($I_{FBO1}$) is increased at the end of the light emitting cycle since the voltage ($V_{FDC}$) is pulled to the first logic level in the first time interval (t1) of the time period (T) where the switch (S1) is in the ON state while the switch (S2) is in the OFF state. In the example as shown in FIG. 6, the magnitude of the current ($I_{FBO1}$) is kept unchanged at the end of the light emitting cycle since the voltage ($V_{FDC}$) is pulled to the first logic level in the second time interval (t2) of the time period (T) where the switch (S1) is in the OFF state while the switch (S2) is in the ON state. In the example as shown in FIG. 7, the magnitude of the current ($I_{FBO1}$) is decreased at the end of the light emitting cycle since the voltage ($V_{FDC}$) is not pulled to the first logic level in the first and second time intervals (t1, t2) of any of the time periods (T).

In view of the above, in this embodiment, by virtue of the first driver circuit 51 determining, based on the voltages ($V_{31,DX1}$-$V_{31,DXn}$), whether to pull the voltage ($V_{FDC}$) to the first logic level, and generating the first control signal based on the voltage ($V_{FDC}$), and by virtue of the first voltage converter circuit 41 adjusting the first output voltage ($V_{out1}$) based on the first control signal, the driving system does not require a processing device and therefore has a relatively lower hardware cost.

Figure 8:
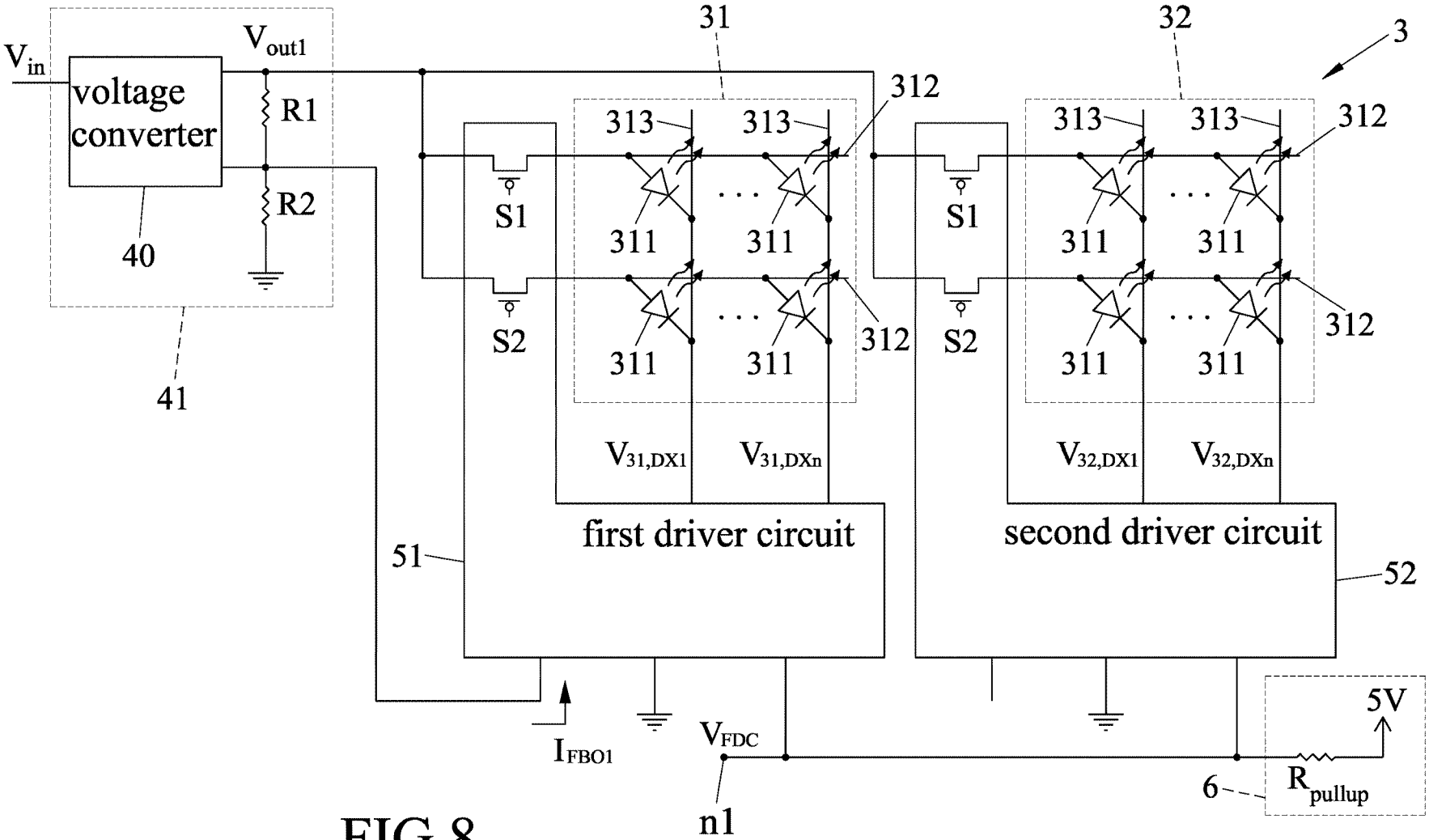
FIG. 8 is a circuit block diagram illustrating a second embodiment of the driving system according to the disclosure.

Referring to FIG. 8, a second embodiment of the driving system according to the disclosure is similar to the first embodiment, and differs from the first embodiment in that: (a) the light emitting device 3 further includes a second light emitting array 32 which is identical to the first light emitting array 31 in structure; and (b) the driving system further includes a second driver circuit 52.

In the second embodiment, the second driver circuit 52 is coupled to the common node (n1), and is adapted to be further coupled to the scan lines 312 and the channel lines 313 of the second light emitting array 32. The second driver circuit 52 drives the light emitting elements 311 of the second light emitting array 32 via the scan lines 312 and the channel lines 313 of the second light emitting array 32, and is operable, based on voltages ($V_{32,DX1}$-$V_{32,DXn}$) at the channel lines 313 of the second light emitting array 32, to pull or not to pull the voltage ($V_{FDC}$) to the first logic level. The second driver circuit 52 includes a plurality of switches (e.g., two switches (S1, S2) in this embodiment). Each of the switches (S1, S2) of the second driver circuit 52 is coupled between the output terminal of the voltage converter 40 of the first voltage converter circuit 41 and a respective one of the scan lines 312 of the second light emitting array 32. For each of the switches (S1, S2) of the second driver circuit 52, the light emitting elements 311 coupled to the switch can emit light when the switch is in an ON state, and cannot emit light when the switch is in an OFF state.

Figure 9:
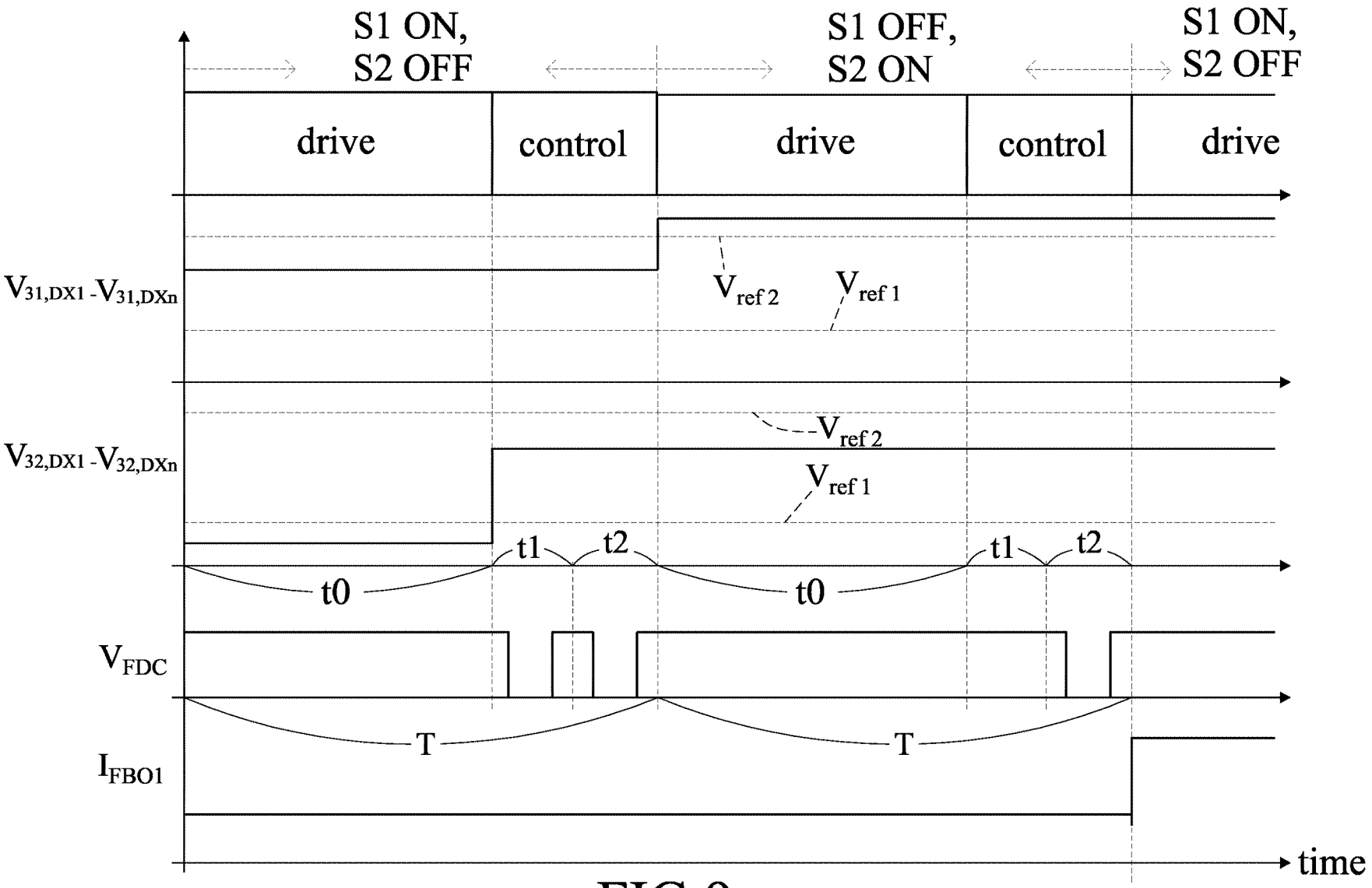
FIG. 9 is an exemplary timing diagram illustrating operation of the second embodiment.

Referring to FIGS. 8 and 9, for each of the rows of the light emitting elements 311 of the second light emitting array 32, the second driver circuit 52 causes the switch (S1/S2) that is coupled to the light emitting elements 311 of the row to be in the ON state in a respective one of the time periods (T), causes the other switch (S1/S2) to be in the OFF state in the respective time period (T), and causes the light emitting elements 311 of the row to emit light in the drive time interval (t0) of the respective time period (T).

In each of the time periods (T), the second driver circuit 52 is operable, based on the voltages ($V_{32,DX1}$-$V_{32,DXn}$) in the drive time interval (t0), to pull or not to pull the voltage ($V_{FDC}$) to the first logic level. When, in the drive time interval (t0), at least one of the voltages ($V_{32,DX1}$-$V_{32,DXn}$) is smaller than the predetermined first reference voltage ($V_{ref1}$) in magnitude, the second driver circuit 52 pulls the voltage ($V_{FDC}$) to the first logic level in the first time interval (t1). When, in the drive time interval (t0), none of the voltages ($V_{32,DX1}$-$V_{32,DXn}$) is smaller than the predetermined first reference voltage ($V_{ref1}$) in magnitude and at least one of the voltages ($V_{32,DX1}$-$V_{32,DXn}$) is smaller than the predetermined second reference voltage ($V_{ref2}$) in magnitude, the second driver circuit 52 pulls the voltage ($V_{FDC}$) to the first logic level in the second time interval (t2). Otherwise, the second driver circuit 52 does not pull the voltage ($V_{FDC}$) to the first logic level in any of the first and second time intervals (t1, t2).

In an example as shown in FIG. 9, in the time period (T) where the switches (S1) of the first and second driver circuits 51, 52 are in the ON state while the switches (S2) of the first and second driver circuits 51, 52 are in the OFF state, the second driver circuit 52 pulls the voltage ($V_{FDC}$) to the first logic level in the first time interval (t1) since all of the voltages ($V_{32,DX1}$-$V_{32,DXn}$) are smaller than the predetermined first reference voltage ($V_{ref1}$) in the drive time interval (t0), and the first driver circuit 51 pulls the voltage ($V_{FDC}$) to the first logic level in the second time interval (t2) since all of the voltages ($V_{31,DX1}$-$V_{31,DXn}$) are greater than the predetermined first reference voltage ($V_{ref1}$) and smaller than the predetermined second reference voltage ($V_{ref2}$) in the drive time interval (t0). In the time period (T) where the switches (S1) of the first and second driver circuits 51, 52 are in the OFF state while the switches (S2) of the first and second driver circuits 51, 52 are in the ON state, the second driver circuit 52 pulls the voltage ($V_{FDC}$) to the first logic level in the second time interval (t2) since all of the voltages ($V_{32,DX1}$-$V_{32,DXn}$) are greater than the predetermined first reference voltage ($V_{ref1}$) and smaller than the predetermined second reference voltage ($V_{ref2}$) in the drive time interval (t0). The first driver circuit 51 increases the magnitude of the current ($I_{FBO1}$) at the end of the light emitting cycle since the voltage ($V_{FDC}$) is pulled to the first logic level in the first time interval (t1) of the time period (T) where the switches (S1) of the first and second driver circuits 51, 52 are in the ON state while the switches (S2) of the first and second driver circuits 51, 52 are in the OFF state.

In view of the above, in this embodiment, by virtue of each of the first and second driver circuits 51, 52 determining, based on the corresponding voltages ($V_{31,DX1}$-$V_{31,DXn}$/$V_{32,DX1}$-$V_{32,DXn}$), whether to pull the voltage ($V_{FDC}$) to the first logic level, by virtue of the first driver circuit 51 generating the first control signal based on the voltage ($V_{FDC}$) and by virtue of the first voltage converter circuit 41 adjusting the first output voltage ($V_{out1}$) based on the first control signal, the driving system does not require a processing device and therefore has a relatively lower hardware cost. In addition, the first output voltage ($V_{out1}$) can have a correct magnitude since the first driver circuit 51 is the only component involved in the generation of the first control signal for receipt by the first voltage converter circuit 41.

Figure 10:
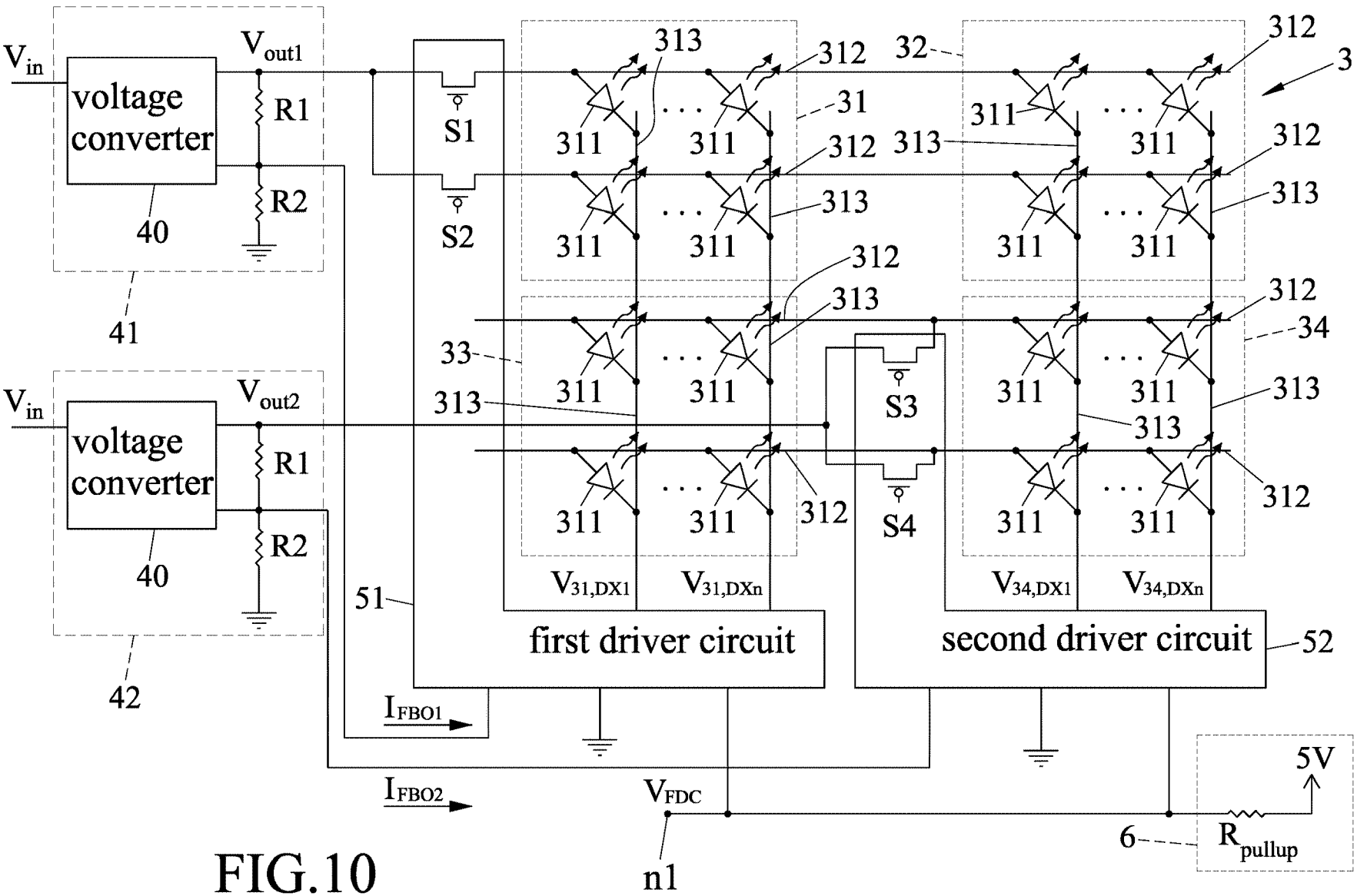
FIG. 10 is a circuit block diagram illustrating a third embodiment of the driving system according to the disclosure.

Referring to FIG. 10, a third embodiment of the driving system according to the disclosure is similar to the first embodiment, and differs from the first embodiment in that: (a) the light emitting device 3 further includes a second light emitting array 32, a third light emitting array 33 and a fourth light emitting array 34, with each of the second to fourth light emitting arrays 32-34 being identical to the first light emitting array 31 in structure; and (b) the driving system further includes a second voltage converter circuit 42 and a second driver circuit 52.

In the third embodiment, the scan lines 312 of the second light emitting array 32 are respectively coupled to the scan lines 312 of the first light emitting array 31, so, for each row of light emitting elements 311 in the first light emitting array 31, the light emitting elements 311 in the row are interconnected with the light emitting elements 311 in a corresponding row in the second light emitting array 32. The scan lines 312 of the third light emitting array 33 are respectively coupled to the scan lines 312 of the fourth light emitting array 34, so, for each row of light emitting elements 311 in the fourth light emitting array 34, the light emitting elements 311 in the row are interconnected with the light emitting elements 311 in a corresponding row in the third light emitting array 33. The channel lines 313 of the third light emitting array 33 are respectively coupled to the channel lines 313 of the first light emitting array 31. The channel lines 313 of the second light emitting array 32 are respectively coupled to the channel lines 313 of the fourth light emitting array 34.

The first driver circuit 51 further drives the light emitting elements 311 of the second and third light emitting arrays 32, 33 via the scan lines 312 and the channel lines 313 of the first light emitting array 31.

The second voltage converter circuit 42 is to receive the input voltage ($V_{in}$) and a second control signal, and to, based on the second control signal, convert the input voltage ($V_{in}$) into a second output voltage ($V_{out2}$) that has a magnitude related to the second control signal. In this embodiment, the second voltage converter circuit 42 is identical to the first voltage converter circuit 41 in structure.

The second driver circuit 52 is coupled to the second voltage converter circuit 42 and the common node (n1), and is adapted to be further coupled to the scan lines 312 and the channel lines 313 of the fourth light emitting array 34. The second driver circuit 52 drives the light emitting elements 311 of the second to fourth light emitting arrays 32-34 via the scan lines 312 and the channel lines 313 of the fourth light emitting array 34. In addition, the second driver circuit 52 is operable, based on voltages ($V_{34,DX1}$-$V_{34,DXn}$) at the channel lines 313 of the fourth light emitting array 34, to pull or not to pull the voltage ($V_{FDC}$) to the first logic level, and generates, based on the voltage ($V_{FDC}$) the second control signal for receipt by the second voltage converter circuit 42. In this embodiment, the second driver circuit 52 includes a plurality of switches (e.g., two switches (S3, S4) in this embodiment). Each of the switches (S3, S4) is coupled between the output terminal of the voltage converter 40 of the second voltage converter circuit 42 and a respective one of the scan lines 312 of the fourth light emitting array 34. For each of the switches (S3, S4), the light emitting elements 311 coupled to the switch can emit light when the switch is in an ON state, and cannot emit light when the switch is in an OFF state. In addition, the second control signal is a current signal ($I_{FBO2}$) that flows from the second voltage converter circuit 42 to the second driver circuit 52.

Figure 11:
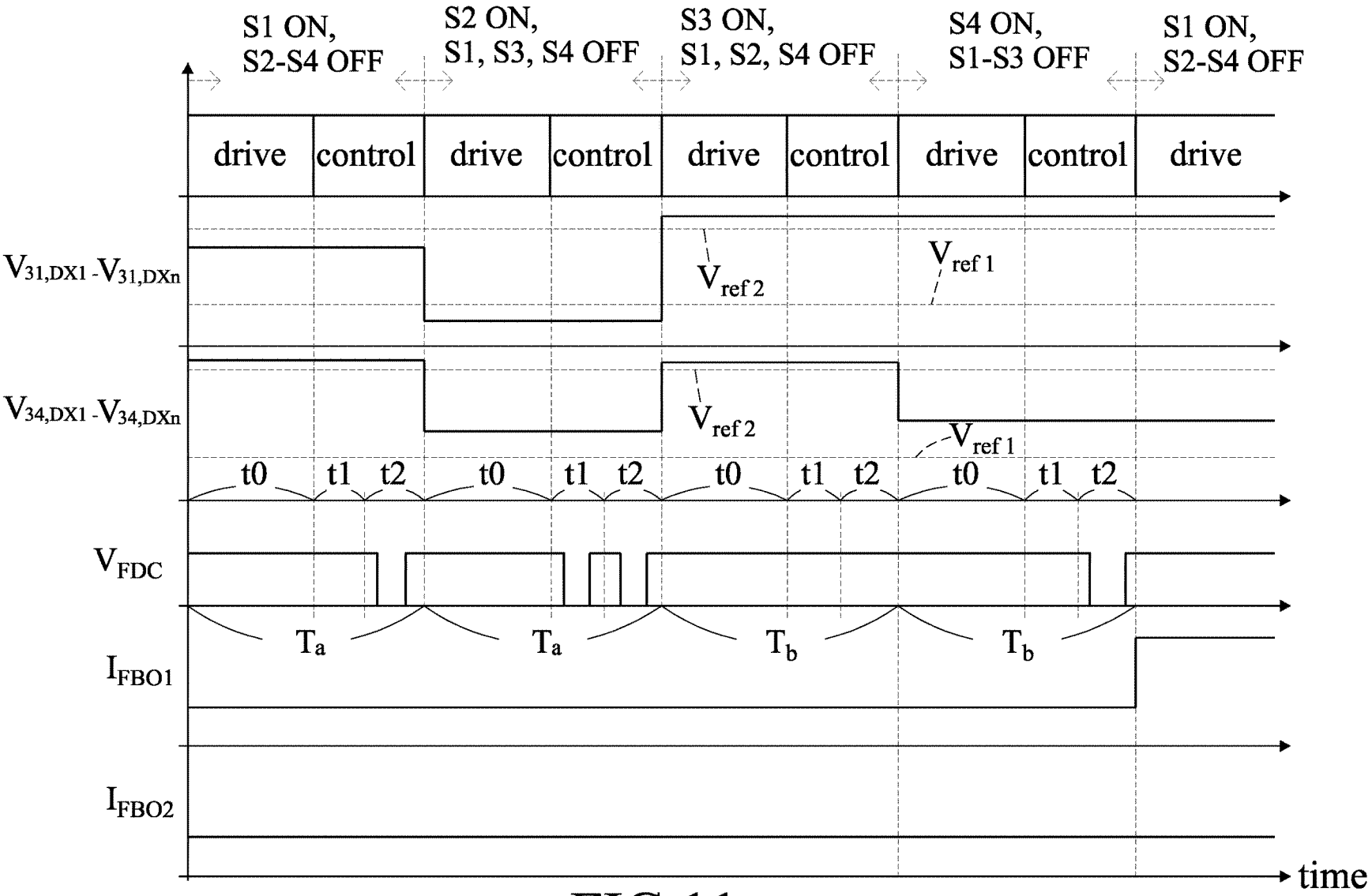
FIG. 11 is an exemplary timing diagram illustrating operation of the third embodiment.

Referring to FIGS. 10 and 11, operations of the driving system of this embodiment will be described in more detail below.

Each light emitting cycle of the driving system of this embodiment is divided into a plurality of first time periods ($T_a$) (e.g., two in this embodiment) and a plurality of second time periods ($T_b$) (e.g., two in this embodiment). Each of the first and second time periods ($T_a$, $T_b$) is divided into three time intervals that include a drive time interval (t0), a first time interval (t1) and a second time interval (t2).

For each of the rows of the light emitting elements 311 of the first light emitting array 31, the first and second driver circuits 51, 52 cooperatively cause the switch (one of S1 and S2) that is coupled to the light emitting elements 311 in the row and the light emitting elements 311 in the corresponding one of the rows of the light emitting elements 311 of the second light emitting array 32 to be in the ON state in a respective one of the first time periods ($T_a$), cause the remaining switches (S3, S4, and the other one of S1 and S2) to be in the OFF state in the respective first time period ($T_a$), and cause these light emitting elements 311 to emit light in the drive time interval (t0) of the respective first time period ($T_a$). For each of the rows of the light emitting elements 311 of the fourth light emitting array 34, the first and second driver circuits 51, 52 cooperatively cause the switch (one of S3 and S4) that is coupled to the light emitting elements 311 in the row and the light emitting elements 311 in the corresponding one of the rows of the light emitting elements 311 of the third light emitting array 33 to be in the ON state in a respective one of the second time periods ($T_b$), cause the remaining switches (S1, S2, and the other one of S3 and S4) to be in the OFF state in the respective second time period ($T_b$), and cause these light emitting elements 311 to emit light in the drive time interval (t0) of the respective second time period ($T_b$).

In each of the first and second time periods ($T_a$, $T_b$), the first driver circuit 51 is operable, based on the voltages ($V_{31,DX1}$-$V_{31,DXn}$) in the drive time interval (t0), to pull or not to pull the voltage ($V_{FDC}$) to the first logic level, and the second driver circuit 52 is operable, based on the voltages ($V_{34,DX1}$-$V_{34,DXn}$) in the drive time interval (t0), to pull or not to pull the voltage ($V_{FDC}$) to the first logic level. When, in the drive time interval (t0), at least one of the voltages ($V_{31,DX1}$-$V_{31,DXn}$) is smaller than the predetermined first reference voltage ($V_{ref1}$) in magnitude, the first driver circuit 51 pulls the voltage ($V_{FDC}$) to the first logic level in the first time interval (t1). When, in the drive time interval (t0), none of the voltages ($V_{31,DX1}$-$V_{31,DXn}$) is smaller than the predetermined first reference voltage ($V_{ref1}$) in magnitude and at least one of the voltages ($V_{31,DX1}$-$V_{31,DXn}$) is smaller than the predetermined second reference voltage ($V_{ref2}$) in magnitude, the first driver circuit 51 pulls the voltage ($V_{FDC}$) to the first logic level in the second time interval (t2). Otherwise, the first driver circuit 51 does not pull the voltage ($V_{FDC}$) to the first logic level in any of the first and second time intervals (t1, t2). When, in the drive time interval (t0), at least one of the voltages ($V_{34,DX1}$-$V_{34,DXn}$) is smaller than the predetermined first reference voltage ($V_{ref1}$) in magnitude, the second driver circuit 52 pulls the voltage ($V_{FDC}$) to the first logic level in the first time interval (t1). When, in the drive time interval (t0), none of the voltages ($V_{34,DX1}$-$V_{34,DXn}$) is smaller than the predetermined first reference voltage ($V_{ref1}$) in magnitude and at least one of the voltages ($V_{34,DX1}$-$V_{34,DXn}$) is smaller than the predetermined second reference voltage ($V_{ref2}$) in magnitude, the second driver circuit 52 pulls the voltage ($V_{FDC}$) to the first logic level in the second time interval (t2). Otherwise, the second driver circuit 52 does not pull the voltage ($V_{FDC}$) to the first logic level in any of the first and second time intervals (t1, t2).

In an example as shown in FIG. 11, in the first time period ($T_a$) where the switch (S1) is in the ON state while the switches (S2-S4) are in the OFF state, the first driver circuit 51 pulls the voltage ($V_{FDC}$) to the first logic level in the second time interval (t2) since all of the voltages ($V_{31,DX1}$-$V_{31,DXn}$) are greater than the predetermined first reference voltage ($V_{ref1}$) and smaller than the predetermined second reference voltage ($V_{ref2}$) in the drive time interval (t0). In the first time period ($T_a$) where the switch (S2) is in the ON state while the switches (S1, S3, S4) are in the OFF state, the first driver circuit 51 pulls the voltage ($V_{FDC}$) to the first logic level in the first time interval (t1) since all of the voltages ($V_{31,DX1}$-$V_{31,DXn}$) are smaller than the predetermined first reference voltage ($V_{ref1}$) in the drive time interval (t0), and the second driver circuit 52 pulls the voltage ($V_{FDC}$) to the first logic level in the second time interval (t2) since all of the voltages ($V_{34,DX1}$-$V_{34,DXn}$) are greater than the predetermined first reference voltage ($V_{ref1}$) and smaller than the predetermined second reference voltage ($V_{ref2}$) in the drive time interval (t0). In the second time period ($T_b$) where the switch (S3) is in the ON state while the switches (S1, S2, S4) are in the OFF state, none of the first and second driver circuits 51, 52 pulls the voltage ($V_{FDC}$) to the first logic level in any of the first and second time intervals (t1, t2) since all of the voltages ($V_{31,DX1}$-$V_{31,DXn}$, $V_{34,DX1}$-$V_{34,DXn}$) are greater than the predetermined second reference voltage ($V_{ref2}$) in the drive time interval (t0). In the second time period ($T_b$) where the switch (S4) is in the ON state while the switches (S1-S3) are in the OFF state, the second driver circuit 52 pulls the voltage ($V_{FDC}$) to the first logic level in the second time interval (t2) since all of the voltages ($V_{34,DX1}$-$V_{34,DXn}$) are greater than the predetermined first reference voltage ($V_{ref1}$) and smaller than the predetermined second reference voltage ($V_{ref2}$) in the drive time interval (t0).

With respect to each light emitting cycle, when the voltage ($V_{FDC}$) is pulled to the first logic level in the first time interval (t1) of at least one of the first time periods ($T_a$) in the light emitting cycle, the first driver circuit 51 increases the magnitude of the current ($I_{FBO1}$) at the end of the light emitting cycle, and the first voltage converter circuit 41 increases the magnitude of the first output voltage ($V_{out1}$) in response. When the voltage ($V_{FDC}$) is not pulled to the first logic level in the first time interval (t1) of any of the first time periods ($T_a$) in the light emitting cycle, and when the voltage ($V_{FDC}$) is pulled to the first logic level in the second time interval (t2) of at least one of the first time periods ($T_a$) in the light emitting cycle, the first driver circuit 51 keeps the magnitude of the current ($I_{FBO1}$) unchanged at the end of the light emitting cycle (i.e., the magnitude of the current ($I_{FBO1}$) in the next light emitting cycle would remain the same as in the current light emitting cycle), so the first voltage converter circuit 41 keeps the magnitude of the first output voltage ($V_{out1}$) unchanged. When the voltage ($V_{FDC}$) is not pulled to the first logic level in any of the first and second time intervals (t1, t2) of any of the first time periods ($T_a$) in the light emitting cycle, the first driver circuit 51 decreases the magnitude of the current ($I_{FBO1}$) at the end of the light emitting cycle, and the first voltage converter circuit 41 decreases the magnitude of the first output voltage ($V_{out1}$) in response.

With respect to each light emitting cycle, when the voltage ($V_{FDC}$) is pulled to the first logic level in the first time interval (t1) of at least one of the second time periods ($T_b$) in the light emitting cycle, the second driver circuit 52 increases the magnitude of the current ($I_{FBO2}$) at the end of the light emitting cycle, and the second voltage converter circuit 42 increases the magnitude of the second output voltage ($V_{out2}$) in response. When the voltage ($V_{FDC}$) is not pulled to the first logic level in the first time interval (t1) of any of the second time periods ($T_b$) in the light emitting cycle, and when the voltage ($V_{FDC}$) is pulled to the first logic level in the second time interval (t2) of at least one of the second time periods ($T_b$) in the light emitting cycle, the second driver circuit 52 keeps the magnitude of the current ($I_{FBO2}$) unchanged at the end of the light emitting cycle, so the second voltage converter circuit 42 keeps the magnitude of the second output voltage ($V_{out2}$) unchanged. When the voltage ($V_{FDC}$) is not pulled to the first logic level in any of the first and second time intervals (t1, t2) of any of the second time periods ($T_b$) in the light emitting cycle, the second driver circuit 52 decreases the magnitude of the current ($I_{FBO2}$) at the end of the light emitting cycle, and the second voltage converter circuit 42 decreases the magnitude of the second output voltage ($V_{out2}$) in response.

In the example as shown in FIG. 11, the magnitude of the current ($I_{FBO1}$) is increased at the end of the light emitting cycle since the voltage ($V_{FDC}$) is pulled to the first logic level in the first time interval (t1) of the first time period ($T_a$) where the switch (S2) is in the ON state while the switches (S1, S3, S4) are in the OFF state. The magnitude of the current ($I_{FBO2}$) is kept unchanged at the end of the light emitting cycle since the voltage ($V_{FDC}$) is pulled to the first logic level in the second time interval (t2) of the second time period ($T_b$) where the switch (S4) is in the ON state while the switches (S1-S3) are in the OFF state.

In view of the above, in this embodiment, by virtue of each of the first and second driver circuits 51, 52 determining, based on the corresponding voltages ($V_{31,DX1}$-$V_{31,DXn}$ or $V_{34,DX1}$-$V_{34,DXn}$), whether to pull the voltage ($V_{FDC}$) to the first logic level, by virtue of each of the first and second driver circuits 51, 52 generating the corresponding one of the first and second control signals based on the voltage ($V_{FDC}$), and by virtue of each of the first and second voltage converter circuits 41, 42 adjusting the corresponding one of the first and second output voltages ($V_{out1}$, $V_{out2}$) based on the corresponding one of the first and second control signals, the driving system does not require a processing device and therefore has a relatively lower hardware cost. In addition, the first output voltage ($V_{out1}$) can have a correct magnitude since the first driver circuit 51 is the only component involved in the generation of the first control signal for receipt by the first voltage converter circuit 41, and the second output voltage ($V_{out2}$) can have a correct magnitude since the second driver circuit 52 is the only component involved in the generation of the second control signal for receipt by the second voltage converter circuit 42.

It should be noted that, in the first to third embodiments, a number of the driver circuits 51, 52 does not play a role in the determination or design of resistances of the resistors (R1, R2) of the converter circuits 41, 42 since each converter circuit 41, 42 receives only one control signal.

Figure 12:
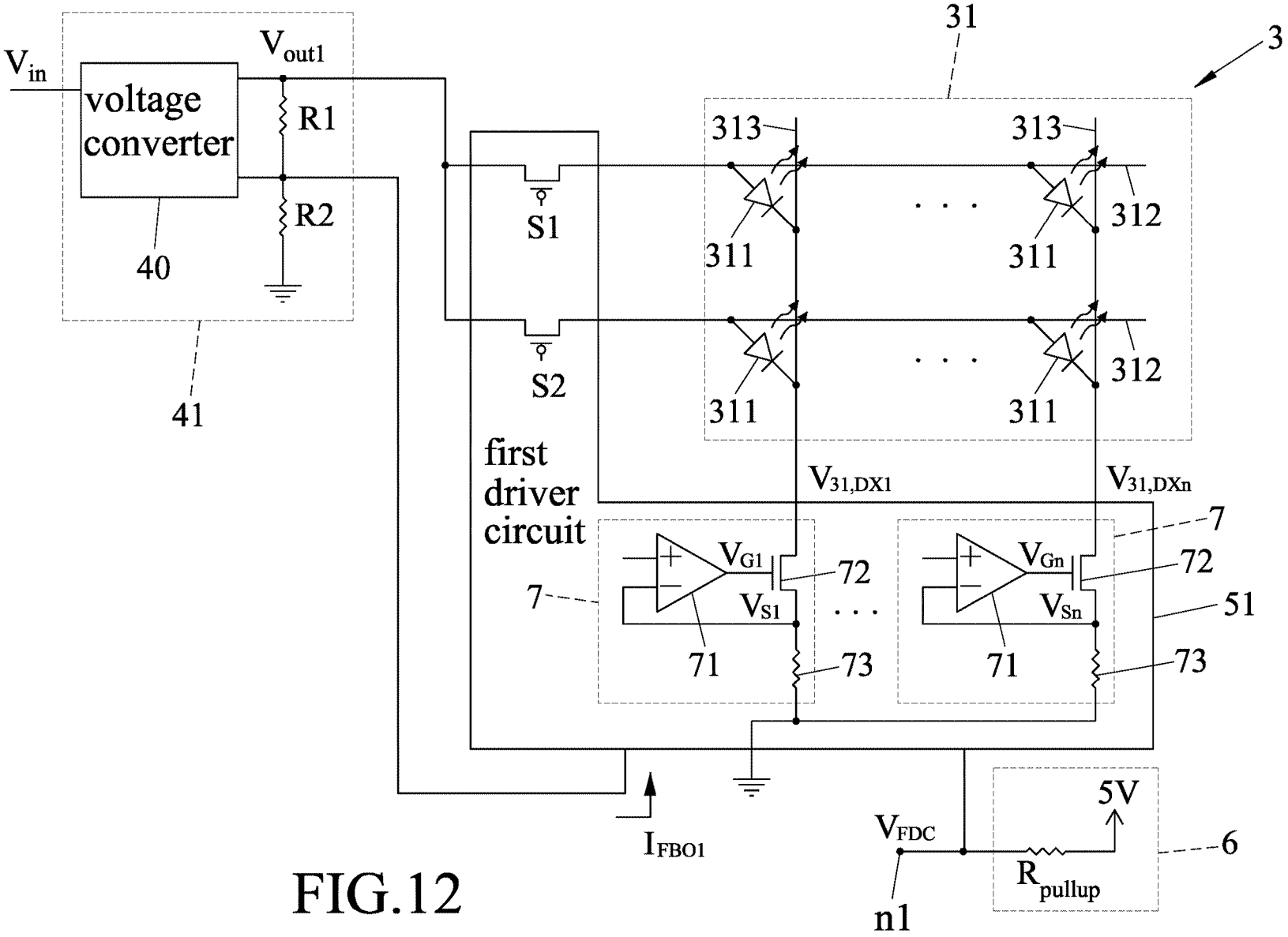
FIG. 12 is a circuit block diagram illustrating a fourth embodiment of the driving system according to the disclosure.

Referring to FIG. 12, a fourth embodiment of the driving system according to the disclosure is similar to the first embodiment, but is different in what are described below.

In the fourth embodiment, the first driver circuit 51 further includes a plurality of current drivers 7 which are to be respectively coupled to the channel lines 313 of the first light emitting array 31, and each of which provides a drive current to the channel line 313 coupled thereto based on a drive voltage. To be specific, each of the current drivers 7 includes an amplifier 71, a transistor 72 and a resistor 73. The amplifier 71 has a non-inverting input terminal that is to receive the drive voltage, an inverting input terminal and an output terminal. The transistor 72 (e.g., an N-type metal oxide semiconductor field effect transistor (nMOSFET)) has a first terminal (e.g., a drain terminal) that is to be coupled to the channel line 313 corresponding to the current driver 7 and that provides the drive current, a second terminal (e.g., a source terminal) that is coupled to the inverting input terminal of the amplifier 71, and a control terminal (e.g., a gate terminal) that is coupled to the output terminal of the amplifier 71. The resistor 73 is coupled between the second terminal of the transistor 72 and ground.

In this embodiment, the first driver circuit 51 is operable, based on voltages ($V_{G1}$-$V_{Gn}$) at the output terminals of the amplifiers 71 of the current drivers 7 instead of the voltages ($V_{31,DX1}$-$V_{31,DXn}$), to pull or not to pull the voltage ($V_{FDC}$) to the first logic level.

Figure 13:
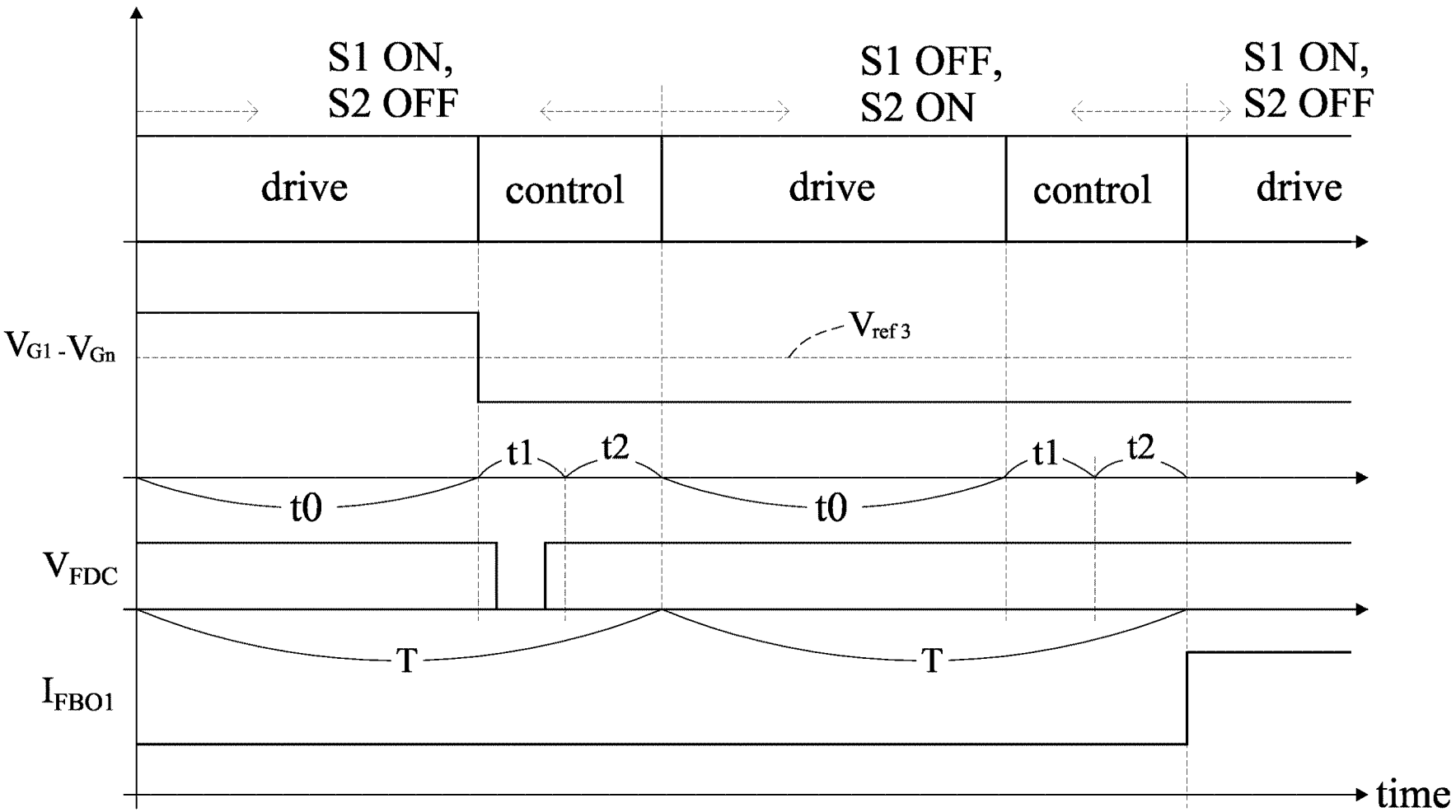
FIGS. 13 and 14 are exemplary timing diagrams illustrating operation of the fourth embodiment.
Figure 14:
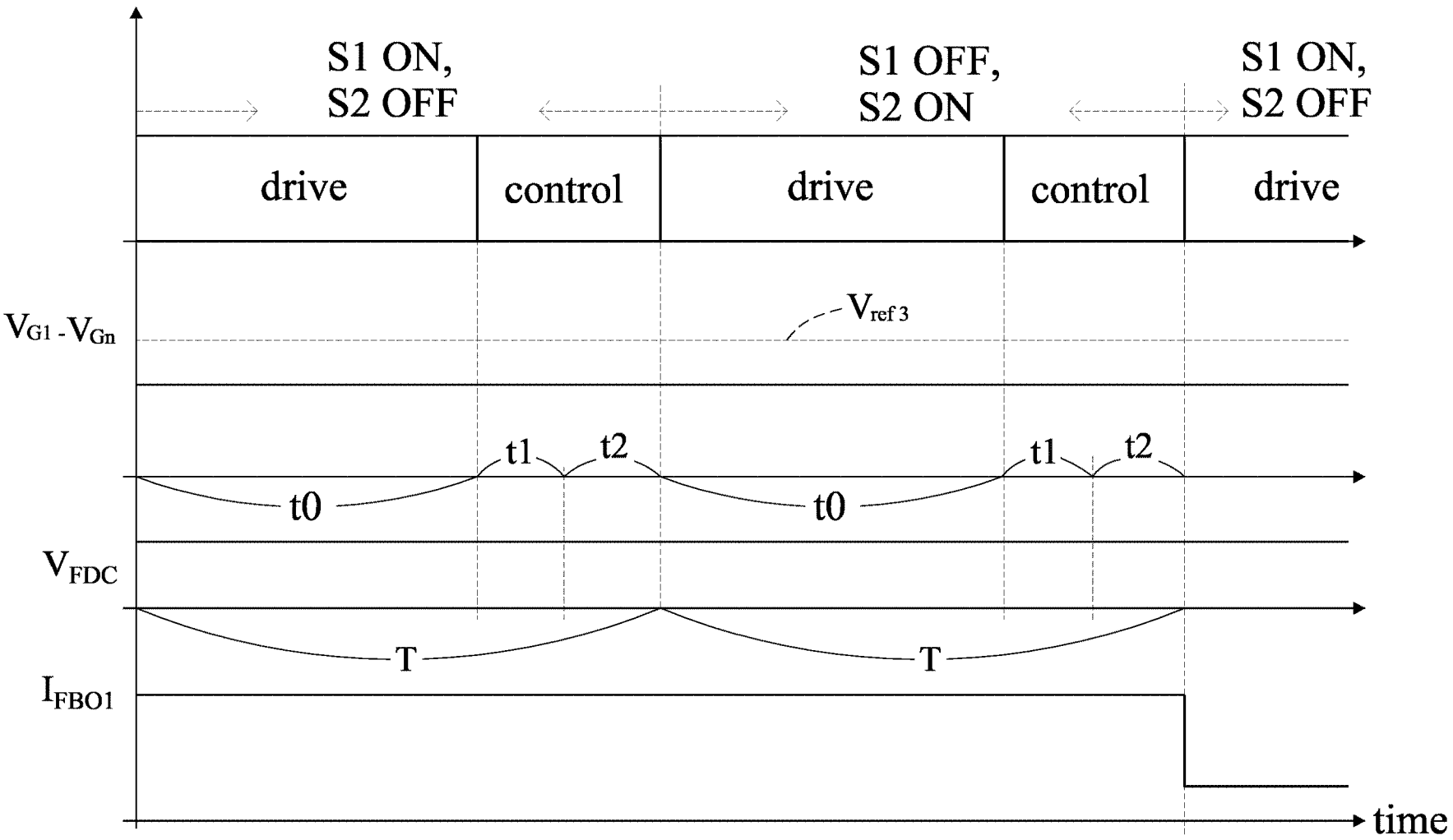

Referring to FIGS. 12 to 14, operations of the driving system of this embodiment will be described in more detail below.

In each of the time periods (T), the first driver circuit 51 is operable, based on the voltages ($V_{G1}$-$V_{Gn}$) in the drive time interval (t0), to pull or not to pull the voltage ($V_{FDC}$) to the first logic level. When, in the drive time interval (t0), at least one of the voltages ($V_{G1}$-$V_{Gn}$) is greater than a predetermined third reference voltage ($V_{ref3}$) in magnitude, the first driver circuit 51 pulls the voltage ($V_{FDC}$) to the first logic level in the first time interval (t1). Otherwise, the first driver circuit 51 does not pull the voltage ($V_{FDC}$) to the first logic level in any of the first and second time intervals (t1, t2).

In an example as shown in FIG. 13, in the time period (T) where the switch (S1) is in the ON state while the switch (S2) is in the OFF state, the voltage ($V_{FDC}$) is pulled to the first logic level in the first time interval (t1) since all of the voltages ($V_{G1}$-$V_{Gn}$) are greater than the predetermined third reference voltage ($V_{ref3}$) in the drive time interval (t0). In the time period (T) where the switch (S1) is in the OFF state while the switch (S2) is in the ON state, the voltage ($V_{FDC}$) is not pulled to the first logic level in the first time interval (t1) since all of the voltages ($V_{G1}$-$V_{Gn}$) are smaller than the predetermined third reference voltage ($V_{ref3}$) in the drive time interval (t0). The magnitude of the current ($I_{FBO1}$) is increased at the end of the light emitting cycle since the voltage ($V_{FDC}$) is pulled to the first logic level in the first time interval (t1) of the time period (T) where the switch (S1) is in the ON state while the switch (S2) is in the OFF state.

In another example as shown in FIG. 14, in each of the time periods (T), the voltage ($V_{FDC}$) is not pulled to the first logic level in the first time interval (t1) since all of the voltages ($V_{G1}$-$V_{Gn}$) are smaller than the predetermined third reference voltage ($V_{ref3}$) in the drive time interval (t0). The magnitude of the current ($I_{FBO1}$) is decreased at the end of the light emitting cycle since the voltage ($V_{FDC}$) is not pulled to the first logic level in the first and second time intervals (t1, t2) of any of the time periods (T).

Referring to FIG. 12, a fifth embodiment of the driving system according to the disclosure is similar to the fourth embodiment, but differs from the fourth embodiment in that the first driver circuit 51 is operable, based on voltages ($V_{S1}$-$V_{Sn}$) at the second terminals of the transistors 72 of the current drivers 7 instead of the voltages ($V_{G1}$-$V_{Gn}$), to pull or not to pull the voltage ($V_{FDC}$) to the first logic level.

Figure 15:
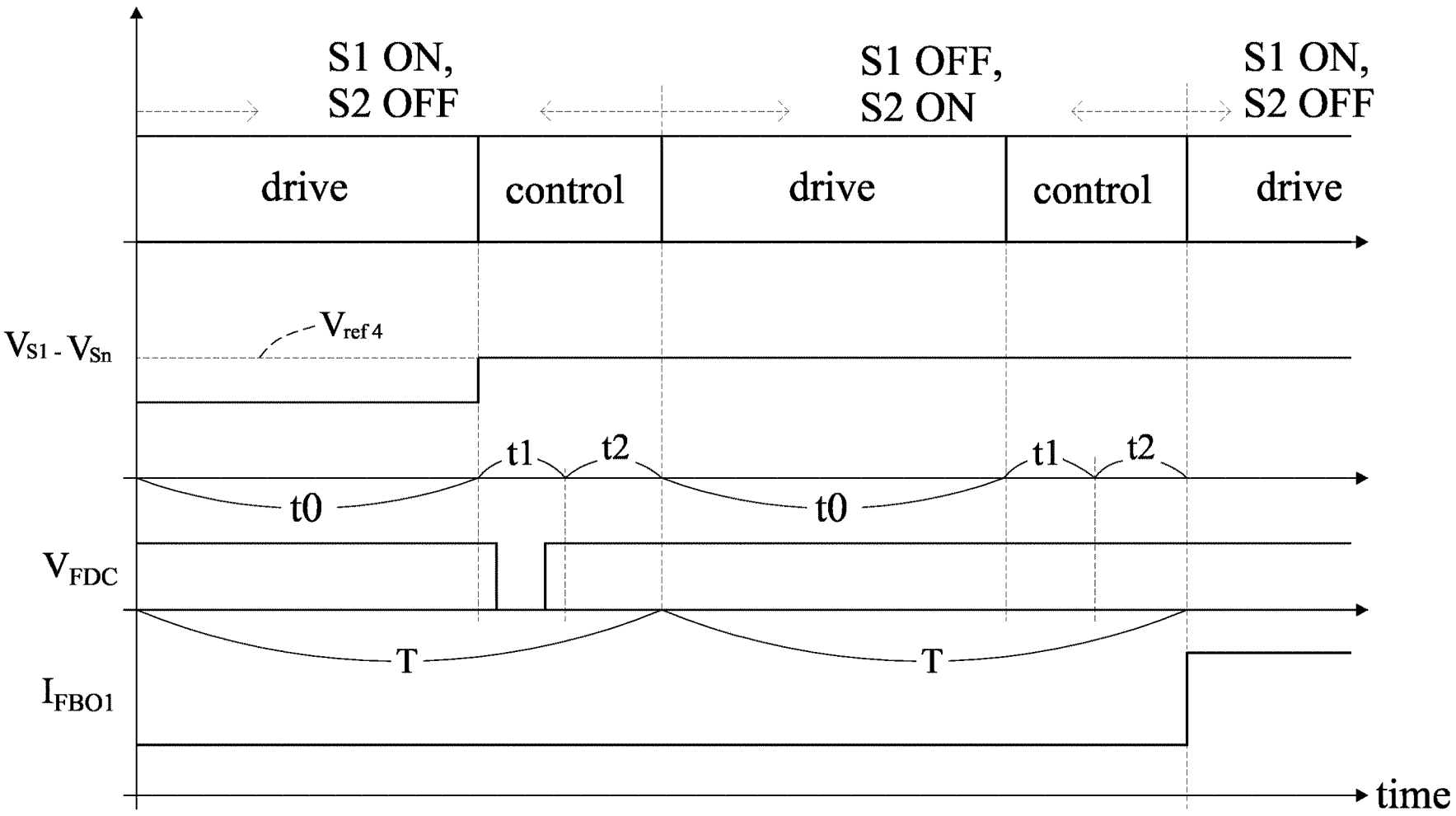
FIGS. 15 and 16 are exemplary timing diagrams illustrating operation of a fifth embodiment of the driving system according to the disclosure.
Figure 16:
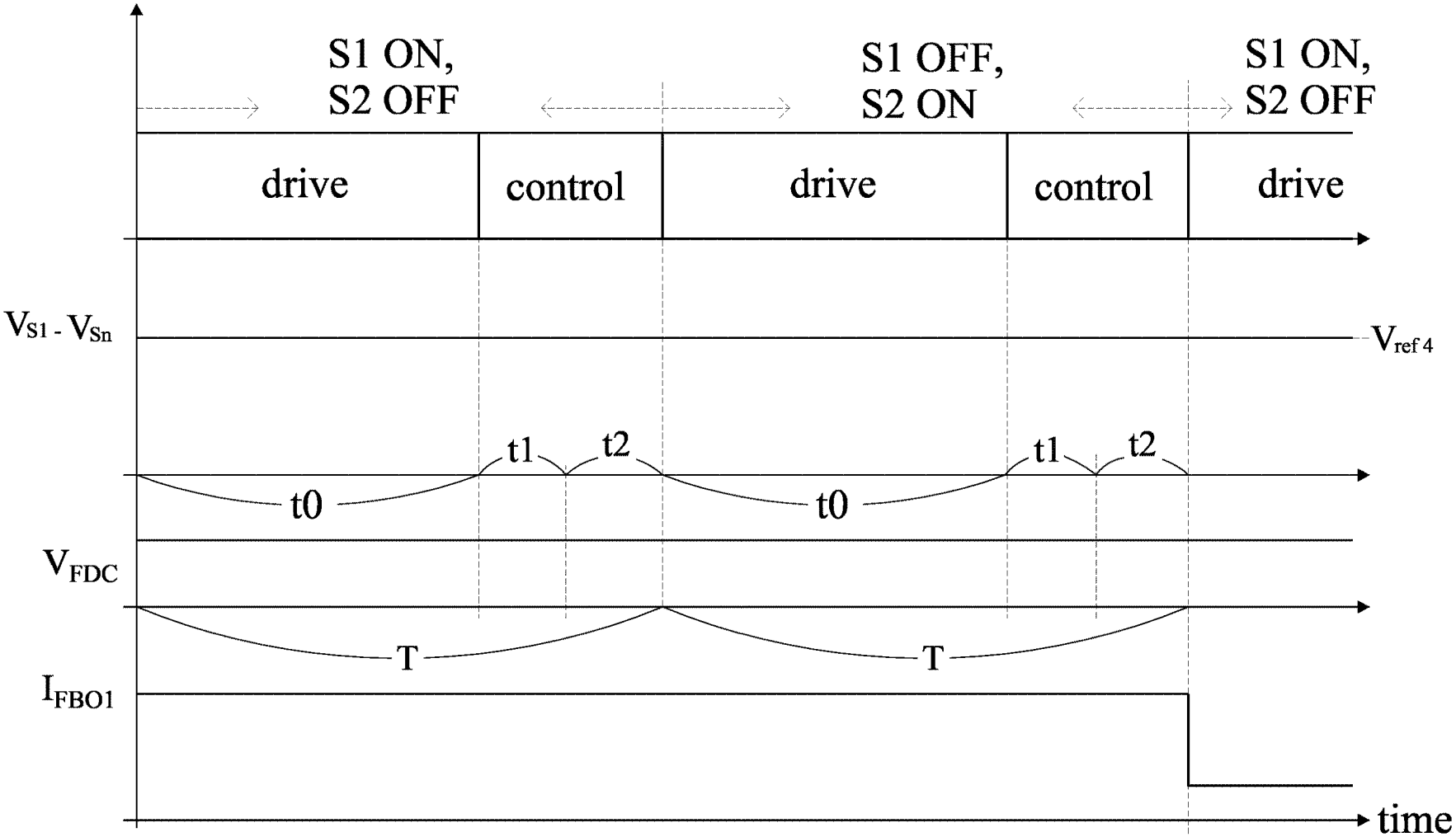

Referring to FIGS. 12, 15 and 16, operations of the driving system of the fifth embodiment will be described in more detail below.

In each of the time periods (T), the first driver circuit 51 is operable, based on the voltages ($V_{S1}$-$V_{Sn}$) in the drive time interval (t0), to pull or not to pull the voltage ($V_{FDC}$) to the first logic level. When, in the drive time interval (t0), at least one of the voltages ($V_{S1}$-$V_{Sn}$) is smaller than a predetermined fourth reference voltage ($V_{ref4}$) in magnitude, the first driver circuit 51 pulls the voltage ($V_{FDC}$) to the first logic level in the first time interval (t1). Otherwise, the first driver circuit 51 does not pull the voltage ($V_{FDC}$) to the first logic level in any of the first and second time intervals (t1, t2).

In an example as shown in FIG. 15, in the time period (T) where the switch (S1) is in the ON state while the switch (S2) is in the OFF state, the voltage ($V_{FDC}$) is pulled to the first logic level in the first time interval (t1) since all of the voltages ($V_{S1}$-$V_{Sn}$) are smaller than the predetermined fourth reference voltage ($V_{ref4}$) in the drive time interval (t0). In the time period (T) where the switch (S1) is in the OFF state while the switch (S2) is in the ON state, the voltage ($V_{FDC}$) is not pulled to the first logic level in the first time interval (t1) since all of the voltages ($V_{S1}$-$V_{Sn}$) are equal to the predetermined fourth reference voltage ($V_{ref4}$) in the drive time interval (t0). The magnitude of the current ($I_{FBO1}$) is increased at the end of the light emitting cycle since the voltage ($V_{FDC}$) is pulled to the first logic level in the first time interval (t1) of the time period (T) where the switch (S1) is in the ON state while the switch (S2) is in the OFF state.

In another example as shown in FIG. 16, in each of the time periods (T), the voltage ($V_{FDC}$) is not pulled to the first logic level in the first time interval (t1) since all of the voltages ($V_{S1}$-$V_{Sn}$) are equal to the predetermined fourth reference voltage ($V_{ref4}$) in the drive time interval (t0). The magnitude of the current ($I_{FBO1}$) is decreased at the end of the light emitting cycle since the voltage ($V_{FDC}$) is not pulled to the first logic level in the first and second time intervals (t1, t2) of any of the time periods (T).

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A driving system operatively associated with a light emitting device that includes a first light emitting array, the first light emitting array including a plurality of scan lines, a plurality of channel lines, and a plurality of light emitting elements that are arranged in a matrix with a plurality of rows and a plurality of columns; in the first light emitting array, with respect to each of the rows, the light emitting elements in the row being coupled to a respective one of the scan lines, and with respect to each of the columns, the light emitting elements in the column being coupled to a respective one of the channel lines; said driving system comprising:

a first voltage converter circuit to receive an input voltage and a first control signal, and to, based on the first control signal, convert the input voltage into a first output voltage that has a magnitude related to the first control signal; and a first driver circuit coupled to said first voltage converter circuit and a common node, and to be further coupled to the scan lines and the channel lines of the first light emitting array, said first driver circuit driving the light emitting elements of the first light emitting array via the scan lines and the channel lines of the first light emitting array, being operable, based on voltages at the channel lines of the first light emitting array, to pull or not to pull a voltage at said common node to a first logic level, and generating, based on the voltage at said common node, the first control signal for receipt by said first voltage converter circuit.

2. The driving system of claim 1, further comprising:

a pull circuit coupled to said common node, and pulling the voltage at said common node to a second logic level when the voltage at said common node is not pulled to the first logic level.

3. The driving system of claim 1, wherein:

for each of the rows of the light emitting elements of the first light emitting array, said first driver circuit causes the light emitting elements of the row to emit light in a respective one of multiple time periods;

in each of the time periods, said first driver circuit is operable, based on the voltages at the channel lines of the first light emitting array, to pull or not to pull the voltage at said common node to the first logic level.

4. The driving system of claim 3, wherein:

each of the time periods includes a first time interval and a second time interval;

in each of the time periods, when at least one of the voltages at the channel lines of the first light emitting array is smaller than a predetermined first reference voltage in magnitude, said first driver circuit pulls the voltage at said common node to the first logic level in the first time interval, and when none of the voltages at the channel lines of the first light emitting array is smaller than the predetermined first reference voltage in magnitude, and when at least one of the voltages at the channel lines of the first light emitting array is smaller than a predetermined second reference voltage in magnitude, said first driver circuit pulls the voltage at said common node to the first logic level in the second time interval, the predetermined second reference voltage being greater than the predetermined first reference voltage in magnitude.

5. The driving system of claim 4, wherein:

when the voltage at said common node is pulled to the first logic level in the first time interval of at least one of the time periods, said first driver circuit generates the first control signal in such a way that said first voltage converter circuit increases the magnitude of the first output voltage;

when the voltage at said common node is not pulled to the first logic level in the first time interval of any of the time periods, and when the voltage at said common node is pulled to the first logic level in the second time interval of at least one of the time periods, said first driver circuit generates the first control signal in such a way that said first voltage converter circuit keeps the magnitude of the first output voltage unchanged;

when the voltage at said common node is not pulled to the first logic level in any of the first and second time intervals of any of the time periods, said first driver circuit generates the first control signal in such a way that said first voltage converter circuit decreases the magnitude of the first output voltage.

6. The driving system of claim 1, the light emitting device further including a second light emitting array that is identical to the first light emitting array in structure, said driving system further comprising:

a second driver circuit coupled to said common node, and to be further coupled to the scan lines and the channel lines of the second light emitting array, said second driver circuit driving the light emitting elements of the second light emitting array via the scan lines and the channel lines of the second light emitting array, and being operable, based on voltages at the channel lines of the second light emitting array, to pull or not to pull the voltage at said common node to the first logic level.

7. The driving system of claim 6, wherein:

for each of the rows of the light emitting elements of the first light emitting array, said first driver circuit causes the light emitting elements of the row to emit light in a respective one of multiple time periods;

for each of the rows of the light emitting elements of the second light emitting array, said second driver circuit causes the light emitting elements of the row to emit light in a respective one of the time periods;

in each of the time periods, said first driver circuit is operable, based on the voltages at the channel lines of the first light emitting array, to pull or not to pull the voltage at said common node to the first logic level, and said second driver circuit is operable, based on the voltages at the channel lines of the second light emitting array, to pull or not to pull the voltage at said common node to the first logic level.

8. The driving system of claim 7, wherein:

each of the time periods includes a first time interval and a second time interval;

in each of the time periods, when at least one of the voltages at the channel lines of the first light emitting array is smaller than a predetermined first reference voltage in magnitude, said first driver circuit pulls the voltage at said common node to the first logic level in the first time interval, and when none of the voltages at the channel lines of the first light emitting array is smaller than the predetermined first reference voltage in magnitude, and when at least one of the voltages at the channel lines of the first light emitting array is smaller than a predetermined second reference voltage in magnitude, said first driver circuit pulls the voltage at said common node to the first logic level in the second time interval, the predetermined second reference voltage being greater than the predetermined first reference voltage in magnitude;

when at least one of the voltages at the channel lines of the second light emitting array is smaller than the predetermined first reference voltage in magnitude, said second driver circuit pulls the voltage at said common node to the first logic level in the first time interval, and when none of the voltages at the channel lines of the second light emitting array is smaller than the predetermined first reference voltage in magnitude, and when at least one of the voltages at the channel lines of the second light emitting array is smaller than the predetermined second reference voltage in magnitude, said second driver circuit pulls the voltage at said common node to the first logic level in the second time interval.

9. The driving system of claim 8, wherein:

when the voltage at said common node is pulled to the first logic level in the first time interval of at least one of the time periods, said first driver circuit generates the first control signal in such a way that said first voltage converter circuit increases the magnitude of the first output voltage;

when the voltage at said common node is not pulled to the first logic level in the first time interval of any of the time periods, and when the voltage at said common node is pulled to the first logic level in the second time interval of at least one of the time periods, said first driver circuit generates the first control signal in such a way that said first voltage converter circuit keeps the magnitude of the first output voltage unchanged;

when the voltage at said common node is not pulled to the first logic level in any of the first and second time intervals of any of the time periods, said first driver circuit generates the first control signal in such a way that said first voltage converter circuit decreases the magnitude of the first output voltage.

10. The driving system of claim 1, the light emitting device further including a second light emitting array, a third light emitting array and a fourth light emitting array, each of the second to fourth light emitting arrays being identical to the first light emitting array in structure, the scan lines of the second light emitting array being respectively coupled to the scan lines of the first light emitting array, the scan lines of the third light emitting array being respectively coupled to the scan lines of the fourth light emitting array, the channel lines of the third light emitting array being respectively coupled to the channel lines of the first light emitting array, the channel lines of the second light emitting array being respectively coupled to the channel lines of the fourth light emitting array, said driving system further comprising:

a second voltage converter circuit to receive the input voltage and a second control signal, and to, based on the second control signal, convert the input voltage into a second output voltage that has a magnitude related to the second control signal; and a second driver circuit coupled to said second voltage converter circuit and said common node, and to be further coupled to the scan lines and the channel lines of the fourth light emitting array, said second driver circuit driving the light emitting elements of the second to fourth light emitting arrays via the scan lines and the channel lines of the fourth light emitting array, being operable, based on voltages at the channel lines of the fourth light emitting array, to pull or not to pull the voltage at said common node to the first logic level, and generating, based on the voltage at said common node, the second control signal for receipt by said second voltage converter circuit;

wherein said first driver circuit further drives the light emitting elements of the second and third light emitting arrays via the scan lines and the channel lines of the first light emitting array.

11. The driving system of claim 10, wherein:

for each of the rows of the light emitting elements of the first light emitting array, said first and second driver circuits cooperatively cause the light emitting elements in the row and the light emitting elements in a corresponding one of the rows of the light emitting elements of the second light emitting array to emit light in a respective one of multiple first time periods, the light emitting elements in the row of the first light emitting array being interconnected with the light emitting elements in the corresponding one of the rows of the second light emitting array;

for each of the rows of the light emitting elements of the fourth light emitting array, said first and second driver circuits cooperatively cause the light emitting elements in the row and the light emitting elements in a corresponding one of the rows of the light emitting elements of the third light emitting array to emit light in a respective one of multiple second time periods the light emitting elements in the row of the fourth light emitting array being interconnected with the light emitting elements in the corresponding one of the rows of the third light emitting array;

in each of the first and second time periods, said first driver circuit is operable, based on the voltages at the channel lines of the first light emitting array, to pull or not to pull the voltage at said common node to the first logic level, and said second driver circuit is operable, based on the voltages at the channel lines of the fourth light emitting array, to pull or not to pull the voltage at said common node to the first logic level.

12. The driving system of claim 11, wherein:

each of the first and second time periods includes a first time interval and a second time interval;

in each of the first and second time periods, when at least one of the voltages at the channel lines of the first light emitting array is smaller than a predetermined first reference voltage in magnitude, said first driver circuit pulls the voltage at said common node to the first logic level in the first time interval, when none of the voltages at the channel lines of the first light emitting array is smaller than the predetermined first reference voltage in magnitude, and when at least one of the voltages at the channel lines of the first light emitting array is smaller than a predetermined second reference voltage in magnitude, said first driver circuit pulls the voltage at said common node to the first logic level in the second time interval, the predetermined second reference voltage being greater than the predetermined first reference voltage in magnitude, when at least one of the voltages at the channel lines of the fourth light emitting array is smaller than the predetermined first reference voltage in magnitude, said second driver circuit pulls the voltage at said common node to the first logic level in the first time interval, and when none of the voltages at the channel lines of the fourth light emitting array is smaller than the predetermined first reference voltage in magnitude, and when at least one of the voltages at the channel lines of the fourth light emitting array is smaller than the predetermined second reference voltage in magnitude, said second driver circuit pulls the voltage at said common node to the first logic level in the second time interval.

13. The driving system of claim 12, wherein:

when the voltage at said common node is pulled to the first logic level in the first time interval of at least one of the first time periods, said first driver circuit generates the first control signal in such a way that said first voltage converter circuit increases the magnitude of the first output voltage;

when the voltage at said common node is not pulled to the first logic level in the first time interval of any of the first time periods, and when the voltage at said common node is pulled to the first logic level in the second time interval of at least one of the first time periods, said first driver circuit generates the first control signal in such a way that said first voltage converter circuit keeps the magnitude of the first output voltage unchanged;

when the voltage at said common node is not pulled to the first logic level in any of the first and second time intervals of any of the first time periods, said first driver circuit generates the first control signal in such a way that said first voltage converter circuit decreases the magnitude of the first output voltage;

when the voltage at said common node is pulled to the first logic level in the first time interval of at least one of the second time periods, said second driver circuit generates the second control signal in such a way that said second voltage converter circuit increases the magnitude of the second output voltage;

when the voltage at said common node is not pulled to the first logic level in the first time interval of any of the second time periods, and when the voltage at said common node is pulled to the first logic level in the second time interval of at least one of the second time periods, said second driver circuit generates the second control signal in such a way that said second voltage converter circuit keeps the magnitude of the second output voltage unchanged;

when the voltage at said common node is not pulled to the first logic level in any of the first and second time intervals of any of the second time periods, said second driver circuit generates the second control signal in such a way that said second voltage converter circuit decreases the magnitude of the second output voltage.

14. A driving system operatively associated with a light emitting array, the light emitting array including a plurality of scan lines, a plurality of channel lines, and a plurality of light emitting elements that are arranged in a matrix with a plurality of rows and a plurality of columns; in the light emitting array, with respect to each of the rows, the light emitting elements in the row being coupled to a respective one of the scan lines, and with respect to each of the columns, the light emitting elements in the column being coupled to a respective one of the channel lines; said driving system comprising:

a voltage converter circuit to receive an input voltage and a control signal, and to, based on the control signal, convert the input voltage into an output voltage that has a magnitude related to the control signal; and a driver circuit coupled to said voltage converter circuit and a common node, and to be further coupled to the scan lines and the channel lines of the light emitting array, said driver circuit driving the light emitting elements of the light emitting array via the scan lines and the channel lines of the light emitting array, being operable to pull or not to pull a voltage at said common node to a logic level, and generating, based on the voltage at said common node, the control signal for receipt by said voltage converter circuit;

said driver circuit including a plurality of current drivers which are to be respectively coupled to the channel lines of the light emitting array, and each of which provides a drive current to the channel line coupled thereto based on a drive voltage;

each of said current drivers including an amplifier having a non-inverting input terminal that is to receive the drive voltage, an inverting input terminal and an output terminal, a transistor having a first terminal that is to be coupled to the channel line corresponding to said current driver and that provides the drive current, a second terminal that is coupled to said inverting input terminal of said amplifier, and a control terminal that is coupled to said output terminal of said amplifier, and a resistor coupled between said second terminal of said transistor and ground.

15. The driving system of claim 14, wherein said driver circuit is operable, based on voltages at said output terminals of said amplifiers of said current drivers, to pull or not to pull the voltage at said common node to the logic level.

16. The driving system of claim 15, wherein:

for each of the rows of the light emitting elements of the light emitting array, said driver circuit causes the light emitting elements of the row to emit light in a respective one of multiple time periods; and in each of the time periods, when at least one of the voltages at said output terminals of said amplifiers of said current drivers is greater than a predetermined reference voltage in magnitude, said driver circuit pulls the voltage at said common node to the logic level.

17. The driving system of claim 16, wherein:

when the voltage at said common node is pulled to the logic level in at least one of the time periods, said driver circuit generates the control signal in such a way that said voltage converter circuit increases the magnitude of the output voltage; and when the voltage at said common node is not pulled to the logic level in any of the time periods, said driver circuit generates the control signal in such a way that said voltage converter circuit decreases the magnitude of the output voltage.

18. The driving system of claim 14, wherein said driver circuit is operable, based on voltages at said second terminals of said transistors of said current drivers, to pull or not to pull the voltage at said common node to the logic level.

19. The driving system of claim 18, wherein:

for each of the rows of the light emitting elements of the light emitting array, said driver circuit causes the light emitting elements of the row to emit light in a respective one of multiple time periods; and in each of the time periods, when at least one of the voltages at said second terminals of said transistors of said current drivers is smaller than a predetermined reference voltage in magnitude, said driver circuit pulls the voltage at said common node to the logic level.

20. The driving system of claim 19, wherein:

when the voltage at said common node is pulled to the logic level in at least one of the time periods, said driver circuit generates the control signal in such a way that said voltage converter circuit increases the magnitude of the output voltage; and when the voltage at said common node is not pulled to the logic level in any of the time periods, said driver circuit generates the control signal in such a way that said voltage converter circuit decreases the magnitude of the output voltage.

* * * * *